US005122445A

United States Patent [19]

Ishigaki

[11] Patent Number: 5,122,445

[45] Date of Patent: Jun. 16, 1992

[54] SILVER HALIDE PHOTOGRAPHIC MATERIALS

[75] Inventor: Kunio Ishigaki, Kanagawa, Japan

[73] Assignee: Fuji Photo Film Co., Ltd., Kanagawa, Japan

[21] Appl. No.: 540,066

[22] Filed: Jun. 19, 1990

[30] Foreign Application Priority Data

Jun. 20, 1989 [JP] Japan ..... 1-157142
Nov. 14, 1989 [JP] Japan ..... 1-295620

[51] Int. Cl.[5] ..... G03C 1/76

[52] U.S. Cl. ..... 430/523; 430/264; 430/527; 430/529; 430/530; 430/631; 430/950; 430/961

[58] Field of Search ..... 430/530, 529, 527, 264, 430/523, 950, 961, 631

[56] References Cited

U.S. PATENT DOCUMENTS 4,094,848 6/1978 Naito ..... 430/950
4,777,113 10/1988 Inoue et al. ..... 430/264
4,999,276 3/1991 Kuwabara et al. ..... 430/264

FOREIGN PATENT DOCUMENTS 0298310 1/1989 European Pat. Off. ..... 430/523
0334400 9/1989 European Pat. Off. .
58-062650 4/1983 Japan ..... 430/527
60-220342 11/1985 Japan ..... 430/523
01267640 10/1989 Japan ..... 430/523
788151 12/1957 United Kingdom .

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A silver halide photographic material is disclosed, comprising a support having thereon at least one light-sensitive silver halide emulsion layer and at least one light-insensitive upper layer, wherein the light-insensitive upper layer contains porous fine powder particles having a surface area of at least 400 $m^2/g$.

20 Claims, No Drawings

SILVER HALIDE PHOTOGRAPHIC MATERIALS

FIELD OF THE INVENTION

This invention concerns silver halide photographic materials and a method for the formation of superhigh contrast negative images in which these materials are used. and in particular it concerns the silver halide photographic materials which are used in photomechanical processes.

BACKGROUND OF THE INVENTION

Image forming systems which exhibit superhigh contrast photographic characteristics (for example with a gamma value of at least 10) are required for improving the reproduction of continuous tones by means of screen dot images and for improving the reproduction of line images in the graphic arts field.

The methods in which hydrazine derivatives are used as disclosed, for example, in U.S. Pat. Nos. 4,224,401, 4,168,977, 4,166,742, 4,311,781, 4,272,606, 4,221,857 4,269,929, are well known as methods by which high contrast photographic characteristics can be obtained using stable developers. Photographic characteristics of high sensitivity with superhigh contrast can be obtained using these methods and the addition of high concentrations of sulfite to the development bath can be tolerated and so the stability of the developer in respect of aerial oxidation is greatly improved in comparison with that of a lith developer.

Typically, the sticking which occurs when contact is made between pieces of photographic material or when a photographic material is brought into contact with the apparatus which is used for processing has been alleviated in the past by the introduction of fine particle powders (matting agents) into the protective layers of the silver halide photographic materials to roughen the surface, and such an addition is often made with a view to improving the anti-static properties of the materials and for improving the vacuum contact properties when making contact exposures.

The matting agents normally used often have an average particle diameter of about 1 to 3 μm. However, a fairly long time is required to achieve perfect contact when making contact exposures with vacuum contact when matting agents of such a size are used. Increasing the particle size of the matting agent and increasing the surface roughness of the photographic material is effective for resolving this problem, but when coating is carried out using simultaneous multi-layer coating apparatus the large size matting agent particles precipitate into the silver halide emulsion layer and this is disadvantageous in that there is a marked increase in the number of pinholes observed after exposure and development processing.

The use of matting agents which have cavities of average diameter at least 200 Å as disclosed in JP-A-64-31149 is one way of improving these materials in respect of pinholes. (The term "JP-A" as used herein signifies an "unexamined published Japanese patent application.") Thus, in this case light scattering is caused by the presence of the cavities and pinholes are avoided. Furthermore, the use of matting agents which have a cavity inside each particle with a wall between the inside and the outside and in which the wall is porous so that the particles do not precipitate in the coating liquid has been disclosed in JP-A-62-163047. However, it is not possible to prevent the occurrence of pinholes using these methods in those cases where a matting agent of large size is used, and further improvement is very desirable.

SUMMARY OF THE INVENTION

A first object of the present invention is to provide silver halide photographic materials which have improved vacuum contact properties for contact exposures and with which few pinholes are formed.

A second object of the present invention is to provide silver halide photographic materials which have the properties described above as the first object of the present invention and with which very high contrast characteristics of gamma exceeding 10 can be obtained using stable developers.

These and other objects of the invention have been realized by a silver halide photographic material comprising a support having provided thereon at least one light-sensitive silver halide emulsion layer and at least one light-insensitive upper layer, wherein the light-insensitive upper layer contains porous fine powder particles of which the surface area is at least 400 $m^2/g$.

DETAILED DESCRIPTION OF THE INVENTION

The matting agent used in the present invention comprises porous fine powder particles and has an average particle size of from 0.1 μm to 20 μm, and preferably of from 1 μm to 10 μm. The surface area of the matting agent is at least 400 $m^2/g$, and preferably from 600 to 1,000 $m^2/g$. The pore size in terms of the average diameter is less than 170 Å, and preferably not more than 150 Å. The surface area and pore size of the matting agent can be determined using the gas adsorption method (BET method). The BET method is specifically explained in S. Brunauer, P. H. Emmett & E. Teller, *J. Am. chem. Soc.*, 60, 309 (1938), S. Brunauer, *The Adsorption of Gases and Vapours*, (1945), etc.

The matting agent used in the present invention may be of any type provided that it is a solid which does not have any adverse effect on photographic characteristics. For example, it may be comprised of an inorganic substance, such as silicon dioxide, titanium and aluminum oxides, zinc and calcium carbonates, barium and calcium sulfates and calcium and aluminum silicates, for example, or a natural or synthotic organic polymer compound such as a cellulose ester, poly(methyl methacrylate), polystyrene or polydivinylbenzene, or copolymers of these compounds.

Known methods which can be used for the preparation of the porous matting agents used in the present invention have been disclosed, for example, in U.S. Pat. Nos. 2,459,903, 2,505,895, 2,462,798, 1,665,264, 3,066,092, 2,469,314, 2,071,987, 2,685,569, 1,935,176 and 4,070,286. The large surface area of such fine porous powders is used in many fields, these materials being used, for example, as catalysts, chromatographic media, in chemical sensors and in filters, and so they can be procured readily on a commercial basis.

The matting agent used in the present invention is added, most desirably, to the uppermost light-insensitive layer, but in cases where the light-insensitive layer is comprised of two or more layers, the matting agent may be included in any of these layers.

The amount of matting agent added is preferably from 5 to 400 $mg/m^2$, and most desirably from 10 to 200 $mg/m^2$ of photographic material.

The inclusion of a lubricant in the uppermost light insensitive layer is desirable in the present invention.

No particular limitation is imposed upon the lubricant used in the present invention, and any compound which, when present at the surface of an object, reduces the friction coefficient of the surface relative to that when the compound is absent can be used for this purpose.

Typical examples of lubricants which can be used in the present invention include the silicone based lubricants disclosed in U.S. Pat. No. 3,042,522, British Patent 955,061, U.S. Pat. Nos. 3,080,317, 4,004,927, 4,047,958 and 3,489,567, and British Patent 1,143,118, the higher fatty acid based, alcohol based and acid amide based lubricants disclosed in U.S. Pat. Nos. 2,454,043, 2,732,305, 2,976,148 and 3,206,311, West German Patents 1,284,295 and 1,284,294, the metal soaps disclosed, for example, in British Patent 1,263,722, and U.S. Pat. No. 3,933,516, the ester based and ether based lubricants disclosed, for example, in U.S. Pat. Nos. 2,588,765 and 3,121,060, and British Patent 1,198,387, and the taurine based lubricants disclosed in U.S. Pat. Nos. 3,502,473 and 3,042,222.

The use of alkyl polysiloxane and liquid paraffins which are in the liquid state at room temperature is preferred. The amount of lubricant used is from 0.1 to 50 wt. %, and preferably from 0.5 to 30 wt. %, with respect to the amount of binder in the layer to which it is added.

Examples of actual compounds which can be used as lubricants are indicated below.

S-1

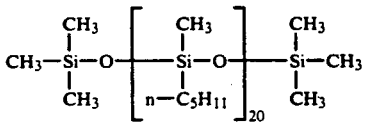

S-2

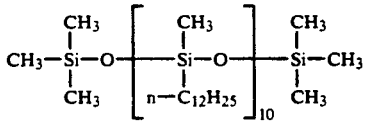

S-3

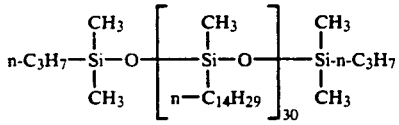

S-4

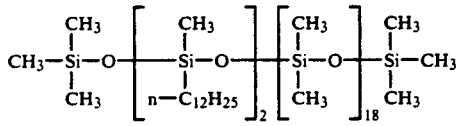

S-5

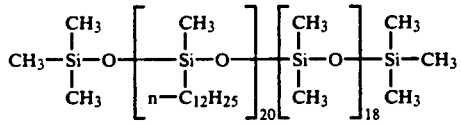

S-6

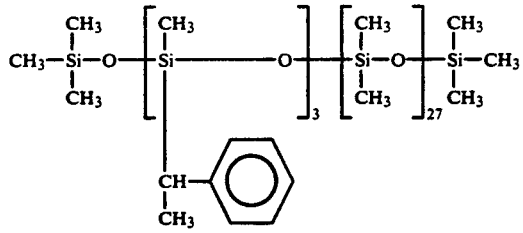

S-7

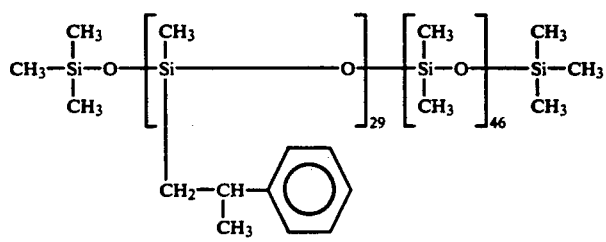

-continued

S-8

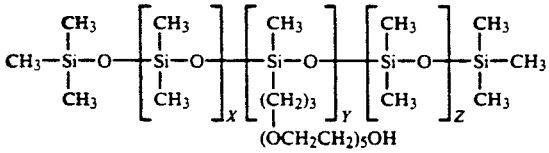

X + Y + Z = 30

S-9

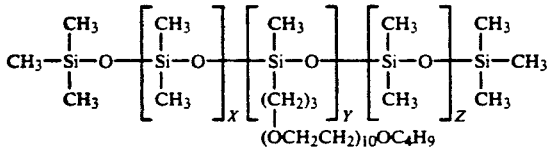

X + Y + Z = 40

$C_3H_7CONHCH_2CH_2SO_3Na$ S-10

$C_9H_{19}CONHCH_2CH_2SO_3Na$ S-11

$C_{17}H_{33}CONHCH_2CH_2SO_3Na$ S-12

S-13

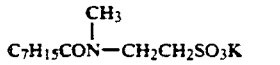

S-14

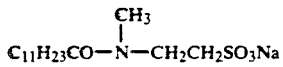

S-15

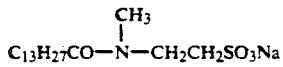

S-16

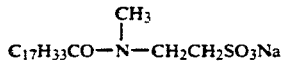

S-17

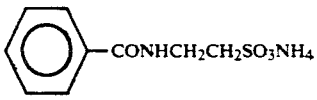

The surface resistivity of at least one of the structural layers of the photographic material of the present invention is preferably not more than $10^{12}$ Ω under an atmosphere of 25% RH at 25° C.

That is to say, the photographic materials of the present invention preferably have an electrically conductive layer.

Electrically conductive metal oxides or electrically conductive polymer compounds, for example, can be used for the electrically conductive substances which are used in the electrically conductive layers in the present invention.

Crystalline metal oxide particles are preferred as the electrically conductive metal oxides which are used in the present invention, and those which contain crystal defects and those which contain a small amount of a different type of atom which forms a donor for the metal oxide which is being used generally have a higher electrical conductivity and are especially preferred, and the latter type are most preferred because they do not cause fogging in silver halide emulsions. Examples of metal oxides include ZnO, $TiO_2$, $SnO_2$, $Al_2O_3$, $In_2O_3$, $SiO_2$, MgO, BaO, $MoO_3$ and $V_2O_5$, or complex oxides thereof, and ZnO, TiOz and $SnO_2$ are especially preferred. Examples of the effective inclusion of different types of atoms in these oxides include the addition of Al and In, for example, to ZnO, the addition of Sb, Nb and halogen elements, for example, to $SnO_2$, and the addition of Nb and Ta, for example, to $TiO_2$. The amount of the different type of atom added is preferably from 0.01 mol % to 30 mol %, and most preferably from 0.1 mol % to 10 mol %.

The fine metal oxide particles in the present invention are electrically conductive, and their volume resistivity is not more than $10^7$ Ω·cm, and preferably not more than $10^5$ Ω·cm.

These oxides have been disclosed, for example, in JP-A-56-143431, JP-A-56-120519 and JP-A-58-62647.

Moreover, electrically conductive materials in which the above mentioned metal oxides are deposited on other crystalline metal oxide particles or fibrous materials (for example titanium oxide) as disclosed in JP-B-59-6235 can also be used. (The term "JP-B" as used herein signifies an "examined Japanese patent publication.")

The size of the particles used is preferably not more than 10 μm, but the stability after dispersion is better and the materials are easier to use if the particle size is not more than 2 μm. Furthermore, it is possible to form transparent photographic materials when electrically conductive particles of particle size not exceeding 0.5 μm are used to reduce light scattering as far as possible, and this is very desirable.

Furthermore, in those cases where the electrically conductive material is needle shaped or fibrous, the length is preferably not more than 30 μm and the diameter is preferably not more than 2 μm, and those which have a length of not more than 25 μm and a diameter of not more than 0.5 μm, and a length/diameter ratio of at least 3, are especially preferred.

Preferred examples of the electrically conductive polymer compounds which can be used in the present invention include polyvinylbenzene sulfonic acid salts, polyvinylbenzyltrimethylammonium chloride, the quaternary salt polymers disclosed in U.S. Pat. Nos. 4,108,802, 4,118,231, 4,126,467 and 4,137,217, and the polymer latexes disclosed, for example, in U.S. Pat. No. 4,070,189, West German Patent Application (OLS) 2,830,767, JP-A-61-296352 and JP-A-61-62033.

The electrically conductive polymer compounds which can be used in the present invention generally have an average molecular weight of 1,000 to 1,000,000, preferably 5,000 to 500,000.

Actual examples of electrically conductive polymer compounds which can be used in the present invention are indicated below, but these compounds are not in any way limited by these examples.

P-1

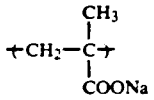

P-2

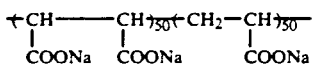

P-3

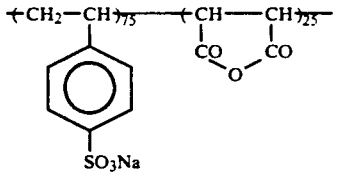

P-4

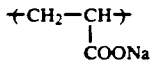

P-5

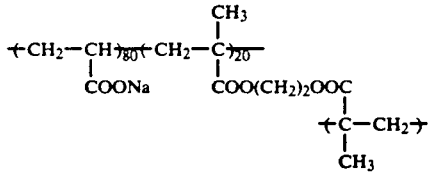

P-6

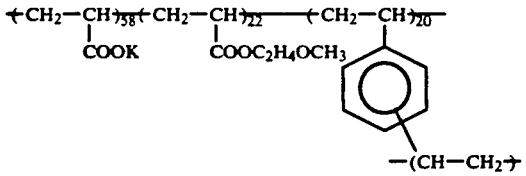

P-7

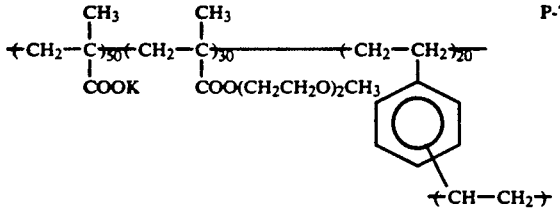

The electrically conductive metal oxides or electrically conductive polymer compounds which can be used in the present invention are dissolved or dispersed in a binder for use.

No particular limitation is imposed upon the binder provided that it has film forming properties, and examples of such binders include gelatin, proteins such as casein, cellulose compounds such as carboxymethylcellulose, hydroxyethylcellulose, acetylcellulose, diacetylcellulose and triacetylcellulose, sugars such as dextran, agar, sodium alginate and starch derivatives, and synthetic polymers such as poly(vinyl alcohol), poly(vinyl acetate), poly(acrylic acid ester), poly(methacrylic acid ester), polystyrene, polyacrylamide,poly(N-vinylpyrrolidone),polyester,poly(vinyl chloride) and poly(acrylic acid).

Gelatin (for example, lime treated gelatin, acid treated gelatin, enzymatically degraded gelatin, phthallated gelatin, acetylated gelatin), acetylcellulose, diacetylcellulose, triacetylcellulose, poly(vinyl acetate), poly(vinyl alcohol), poly(butyl acrylate), polyacrylamide and dextran, for example, are especially preferable as binders.

A high by-volume content of the electrically conductive substance in the electrically conductive layer is desirable for making more effective use of the electrically conductive metal oxide or electrically conductive polymer compound which can be used in the present invention and reducing the resistance of the electrically conductive layer, but a minimum binder content of about 5% by volume is required for providing the layer with an adequate strength and so the content, by volume, of the electrically conductive metal oxide or electrically conductive polymer compound is preferably within the range from 5 to 95%.

The amount of electrically conductive metal oxide or electrically conductive polymer compound which can be used in the present invention is preferably from 0.05 to 20 grams, and most desirably from 0.1 to 10 grams, per square meter of photographic material. The surface resistivity of the electrically conductive layer in the present invention in an atmosphere of 25% RH at 25° C. is not more than $10^{12}$ Ω, and most desirably not more than $10^{11}$ Ω. Good anti-static properties are obtained in this way.

At least one electrically conductive layer which contains the electrically conductive metal oxide or electrically conductive polymer compound which can be used in the present invention preferably is provided as a structural layer of the photographic materials in the present invention. For example, it may form a surface protective layer, a backing layer, an intermediate layer or an undercoating layer, and two or more such layers may be provided, as required.

A further improvement can be made in respect of the anti-static properties in the present invention by using fluorine-containing surfactants conjointly in addition to the above mentioned electrically conductive substances.

Surfactants which have a fluoroalkyl, fluoroalkenyl or fluoroaryl group which has at least 4 carbon atoms, and which have, as an ionic group, an anionic group (sulfonic acid (or salt), sulfuric acid (or salt), carboxylic acid (or salt), phosphoric acid (or salt)), a cationic group (amine salt, ammonium salt, aromatic amine salt, sulfonium salt, phosphonium salt), a betaine group (carboxyamine salt, carboxyammonium salt, sulfoamine salt, sulfoammonium salt, phosphoammonium salt), or a non-ionic group (substituted or unsubstituted polyoxyalkylene group, polyglyceryl group or sorbitan residual group) can be used as the fluorine-containing surfactants which are preferably used in the present invention.

These fluorine-containing surfactants have been disclosed, for example, in JP-A-49-10722, British Patent 1,330,356, U.S. Pat. Nos. 4,335,201 and 4,347,308, British Patent 1,417,915, JP-A-55-149938, JP-A-58-196544 and British Patent 1,439,402.

Actual examples of these surfactants are indicated below.

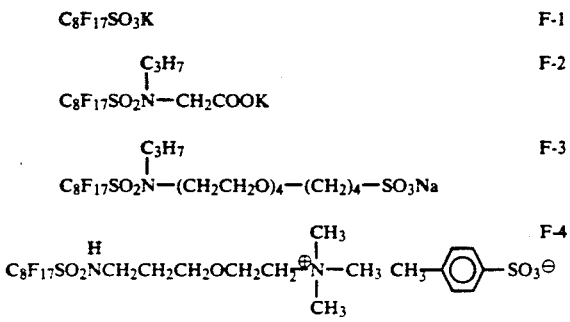

No limitation is imposed upon the layer to which the fluorine-containing surfactant is added in the present invention, provided that it is preferably added to at least one layer in the photographic material, and it can be added, for example, to a surface protecting layer, an emulsion layer, an intermediate layer, an undercoating layer or a backing layer. The fluorine containing surfactant is preferably added to the surface protecting layer, and its inclusion in the protective layer on either the emulsion layer side or the backing layer side, or in the protective layers on both sides, is especially desirable.

In those cases where the surface protecting layer is comprised of two or more layers, the fluorine-containing surfactant may be used in any of these layers, or it can be used as an overcoat over the surface protecting layer.

The amount of fluorine-containing surfactant used in the present invention is from 0.0001 to 1 gram, preferably from 0.0002 to 0.25 gram, and most preferably from 0.0003 to 0.1 gram, per square meter of photographic material.

Furthermore, two or more types of fluorine-containing surfactant can be used in the form of a mixture in the present invention.

Other anti-static agents can be used conjointly in the layer which contains the fluorine-containing surfactant or in another separate layer in the present invention, and it is possible to obtain a more desirable anti-static effect in this way.

The hydrazine compounds represented by general formula (I) below or tetrazolium compounds can be used to harden the contrast of the silver halide photographic materials of the present invention.

The hydrazine compounds which can be used in the silver halide photographic materials of the present invention are preferably compounds which can be represented by the general formula (I) indicated below.

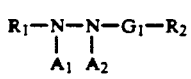

(I)

In this formula, $R_1$ represents an aliphatic group or an aromatic group, $R_2$ represents a hydrogen atom, an alkyl group, an aryl group, an alkoxy group, an aryloxy group, an amino group, a hydrazino group, a carbamoyl group or an oxycarbonyl group, $G_1$ represents a carbamoyl group, a sulfonyl group, a sulfoxy group,

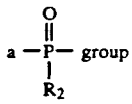

where $R_2$ is as defined above,

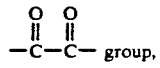

a thiocarbonyl group or an iminomethylene group, and $A_1$ and $A_2$ both represent hydrogen atoms, or one represents a hydrogen atom and the other represents a substituted or unsubstituted alkylsulfonyl group, or a substituted or unsubstituted arylsulfonyl group, or a substituted or unsubstituted acyl group.

The aliphatic groups represented by $R_1$ in general formula (I) preferably have from 1 to 30 carbon atoms, and they are most desirably linear chain, branched or cyclic alkyl groups which have from 1 to 20 carbon atoms. The branched alkyl groups may be cyclized in such a way that a saturated heterocyclic ring containing one or more hetero atoms is formed. Furthermore, the alkyl group may have substituent groups, for example aryl, alkoxy, sulfoxy, sulfonamido or carboxamido substituent groups.

The aromatic groups represented by $R_1$ in general formula (I) are single ring or double ring aryl groups or unsaturated heterocyclic groups. The unsaturated heterocyclic groups may be condensed with a single ring or a double ring aryl group to form hetero-aryl groups.

For example, $R_1$ may be a benzene ring, a naphthalene ring, a pyridine ring, a pyrimidine ring, an imidazole ring, a pyrazole ring, a quinoline ring, an isoquinoline ring, a benzimidazole ring, a thiazole ring or a benzothiazole ring, and of these, those which contain a benzene ring are preferred.

Aryl groups are especially preferred as $R_1$.

The aryl groups or unsaturated heterocyclic groups represented by $R_1$ may be substituted, and typical substituent groups include, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carboxamido group, a sulfonamido group, a carboxyl group, a phosphoric acid amido group, a diacylamino group, an imido group and a

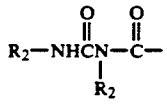

group where $R_2$ is the same as defined above. The preferred substituent groups are, for example, linear chain, branched or cyclic alkyl groups (which preferably have from 1 to 20 carbon atoms), aralkyl groups (preferably single ring or double ring groups of which the alkyl moiety has from 1 to 3 carbon atoms), alkoxy groups (which preferably have from 1 to 20 carbon atoms), substituted amino groups (preferably amino groups substituted with alkyl groups which have from 1 to 20 carbon atoms), acylamino groups (which preferably have from 2 to 30 carbon atoms), sulfonamido groups (which preferably have from 1 to 30 carbon atoms), ureido groups (which preferably have from 1 to 30 carbon atoms) and phosphoric acid amido groups (which preferably have from 1 to 30 carbon atoms).

The alkyl groups represented by $R_2$ in general formula (I) are preferably alkyl groups which have from 1 to 4 carbon atoms, and these may be substituted, for example, with a halogen atom, a cyano group, a carboxyl group, a sulfo group, an alkoxy group, a phenyl group, an acyl group, an alkoxycarbonyl group, an aryloxycarbonyl group, a carbamoyl group, an alkylsulfo group, an arylsulfo group, a sulfamoyl group, a nitro group, a heteroaromatic group and/or a

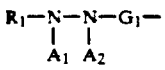

group where $R_1$, $G_1$, $A_1$ and $A_2$ have the same meaning as in formula (I), and these groups may also be substituted.

The aryl groups represented by $R_2$ in general formula (I) are preferably single ring or double ring aryl groups, for example, groups which contain a benzene ring. These aryl groups may be substituted, for example, with the same substituent groups as described above in connection with the alkyl groups represented by $R_2$.

The alkoxy groups represented by $R_2$ in general formula (I) preferably have from 1 to 8 carbon atoms, and they may be substituted, for example, with halogen atoms and aryl groups.

The aryloxy groups represented by $R_2$ in general formula (I) preferably have a single ring and this may have a halogen atom, for example, as a substituent group.

The amino groups represented by $R_2$ in general formula (I) are preferably unsubstituted amino groups, or alkylamino groups which have from 1 to 10 carbon atoms, or arylamino groups, and they may be substituted, for example, with an alkyl group, a halogen atom, a cyano group, a nitro group and/or a carboxyl group.

The carbamoyl groups represented by $R_2$ in general formula (I) are preferably unsubstituted carbamoyl groups or alkyl carbamoyl groups which have from 1 to 10 carbon atoms, or arylcarbamoyl groups, and they may be substituted, for example, with an alkyl group, a halogen atom, a cyano group and/or a carboxyl group.

The oxycarbonyl groups represented by $R_2$ in general formula (I) are preferably alkoxycarbonyl groups which have from 1 to 10 carbon atoms, or aryloxycarbonyl groups, and they may be substituted, for example, with an alkyl group, a halogen atom, a cyano group and/or a nitro group.

In those cases where $G_1$ is a carbonyl group, the preferred groups among those which can be represented by $R_2$ are, for example, a hydrogen atom, an alkyl group (for example, methyl, trifluoromethyl, 3-hydroxypropyl, 3-methanesulfonamidopropyl, phenylsulfonylmethyl), an aralkyl group (for example, o-hydroxybenzyl) and an aryl group (for example, phenyl, 3,5-dichlorophenyl, o-methanesulfonamidophenyl, 4-methanesulfonylphenyl), and the hydrogen atom is especially preferred.

Furthermore, in those cases where $G_1$ is a sulfonyl group, $R_2$ is preferably an alkyl group (for example, methyl), an aralkyl group (for example, o-hydroxyphenylmethyl), an aryl group (for example, phenyl), or a substituted amino group (for example, dimethylamino).

In those cases where $G_1$ is a sulfoxy group, $R_2$ is preferably a cyanobenzyl group or a methylthiobenzyl group, and in those cases where $G_1$ is a

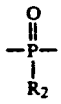

group, $R_2$ in general formula (I) is preferably a methoxy, ethoxy, butoxy, phenoxy or phenyl group, and most preferably a phenoxy group.

In those cases where $G_1$ represents an N-substituted or unsubstituted iminomethylene group, $R_2$ is preferably a methyl, ethyl, or substituted or unsubstituted phenyl group.

The substituent groups listed in connection with $R_1$ are appropriate as substituent groups for $R_2$.

$G_1$ in general formula (I) is most preferably a carbonyl group.

Furthermore, $R_2$ may be a group such that the $G_1$-$R_2$ moiety is cleaved from the rest of the molecule and a cyclization reaction occurs, forming a ring structure which contains the atoms of the —$G_1$—$R_2$ moiety, and in practice this may be represented by the general formula (a):

$$-R_3-Z_1 \qquad \text{(a)}$$

In this formula (a), $Z_1$ is a group which makes a nucleophilic attack on $G_1$ and cleaves the $G_1$-$R_3$-$Z_1$ moiety from the rest of the molecule and $R_3$ is a group derived by removing one hydrogen atom from $R_2$ in general formula (I), and $Z_1$ can make a nucleophilic attack on $G_1$ and form a ring structure with $G_1$, $R_3$ and $Z_1$.

More precisely, $R_3$ is a group derived by substituting one hydrogen atom of the group of $R_2$ in general formula (I) with $Z_1$, provided that a hydrogen atom is excluded from the group of $R_2$, and $Z_1$ is a group which, when the reaction intermediate $R_1$—N=N—$G_1$—$R_3$—$Z_1$ has been formed by the oxidation of the hydrazine compound of general formula (I) for example, readily undergoes a nucleophilic reaction with $G_1$ and causes the $R_1$—N=N group to be cleaved from $G_1$, and in practice it may be a functional group which reacts directly with $G_1$, such as OH, SH or $NHR_4$ (where $R_4$ is a hydrogen atom, an alkyl group, an aryl group, —$COR_5$ or —$SO_2R_5$, where $R_5$ represents a hydrogen atom, an alkyl group, an aryl group or a heterocyclic group for example), or —COOH (the OH, SH, $NHR_4$, and —COOH groups in this case may be temporarily protected in such a way that these groups are formed by hydrolysis with an alkali, for example), or a functional group which can react with $G_1$ as a result of the reaction of a nucleophilic agent such as a hydroxide ion or a sulfite ion, such as

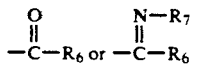

(where $R_6$ and $R_7$ each represents a hydrogen atom, an alkyl group, an alkenyl group, an aryl group or a heterocyclic group).

Furthermore, the ring formed by $G_1$, $R_3$ and $Z_1$ is preferably a five or six membered ring.

Those of the groups represented by general formula (a) which can be represented by the following general formulae (b) and (c) are preferred.

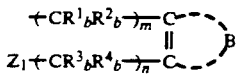

(b)

In formula (b), $R_b^1$ - $R_b^4$ each represents, for example, a hydrogen atom, an alkyl group (which preferably has from 1 to 12 carbon atoms), an alkenyl group (which preferably has from 2 to 12 carbon atoms) or an aryl group (which preferably have from 6 to 12 carbon atoms), and they may be the same or different. B represents the atoms which are required to complete a five or six membered ring which may have substituent groups, m and n each represents 0 or 1, and (m+n) has a value of 1 or 2.

Examples of five or six membered rings formed by B include the cyclohexene ring, the cycloheptene ring, the benzene ring, the naphthalene ring, the pyridine ring and the quinoline ring.

$Z_1$ in formula (b) has the same significance as in general formula (a).

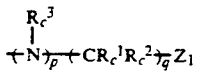

(c)

In formula (c), $R_c^1$ and $R_c^2$ each represents, for example, a hydrogen atom, an alkyl group, an alkenyl group, an aryl group or a halogen atom, and they may be the same or different.

$R_c^3$ represents a hydrogen atom, an alkyl group, an alkenyl group or an aryl group.

Moreover, p represents 0 or 1, and q represents 1, 2, 3 or 4.

$R_c^1$, $R_c^2$and $R_c^3$ may be joined together to form a ring, provided that the structure permits an intramolecular nucleophilic attack by $Z_1$ on $G_1$.

$R_c^1$ and $R_c^2$ are preferably a hydrogen atom, a halogen atom or an alkyl group, and $R_c^3$ is preferably an alkyl group or an aryl group.

Moreover, q preferably has a value of from 1 to 3, and when q is 1, p is 0 or 1; when q is 2, p is 0 or 1; and when q is 3, p is 0 or 1. Moreover, when q is 2 or 3, the $CR_c^1R_c^2$ groups may be the same or different. $Z_1$ in formula (c) has the same significance as in general formula (a).

$A_1$ and $A_2$ in general formula (I) each represents a hydrogen atom, an alkylsulfonyl group which has not more than 20 carbon atoms, an arylsulfonyl group (preferably an unsubstituted phenylsulfonyl group or a substituted phenylsulfonyl group in which the sum of the Hammett's substituent constants is at least −0.5), an acyl group which has not more than 20 carbon atoms (preferably an unsubstituted benzoyl group or a substituted benzoyl group in which the sum of the Hammett's substituent constants is at least −0.5, or a linear chain, branched or cyclic unsubstituted or substituted aliphatic acyl group (which has a halogen atom, an ether group, a sulfonamido group, a carboxamido group, a hydroxyl group, a carboxyl group or a sulfonic acid group as a substituent group)).

$A_1$ and $A_2$ are most preferably hydrogen atoms.

The groups represented by $R_1$ or $R_2$ in general formula (I) may have incorporated within them ballast groups or polymers as normally used in immobile photographically useful additives such as couplers. Ballast groups are groups which are comparatively inert in the photographic sense, which have at least eight carbon atoms, and they can be selected, for example, from among an alkyl group, an alkoxy group, a phenyl group, an alkylphenyl group, a phenoxy group and an alkylphenoxy group. Furthermore, those disclosed, for example, in JP-A-1-100530 can be cited as polymers which can be used.

Either one of $R_1$ or $R_2$ in general formula (I) may have incorporated within it a group which is adsorbed strongly on silver halide grain surfaces. Examples of such adsorbing groups include a thiourea group, a heterocyclic thioamido group, a mercapto-heterocyclic group and a triazole group disclosed, for example, in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244 and JP-A-63-234246.

Actual examples of compounds represented by general formula (I) are indicated below by compounds (I-1) to (I-58), but the invention is not limited to these compounds.

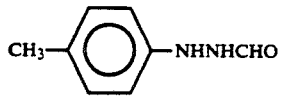

(I-1)

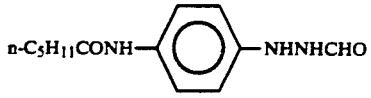

(I-2)

-continued
(I-3)
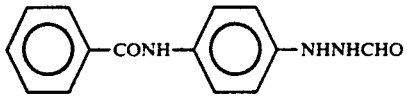
(I-4)
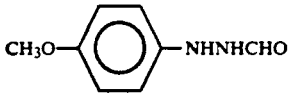
(I-5)
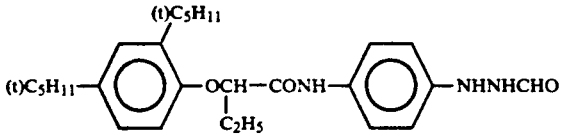
(I-6)
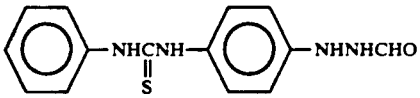
(I-7)
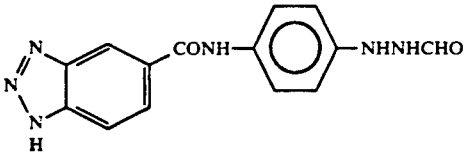
(I-8)
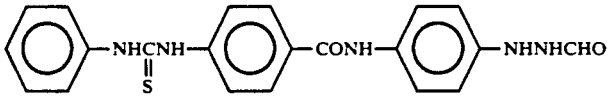
(I-9)
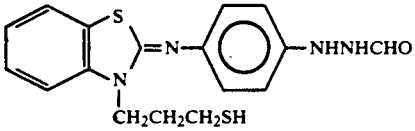
(I-10)
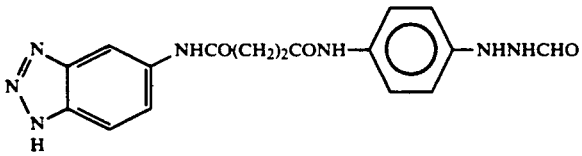
(I-11)
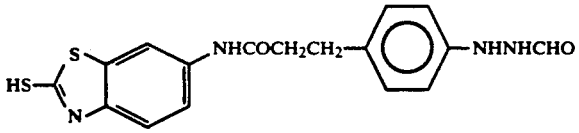
(I-12)
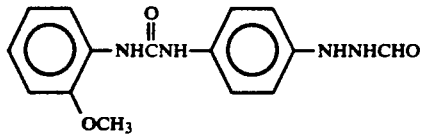
(I-13)
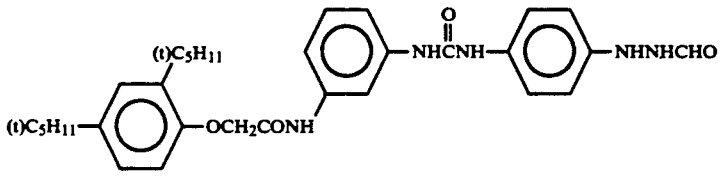

-continued
(I-14)
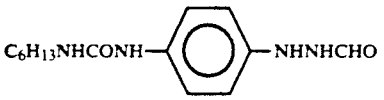
(I-15)
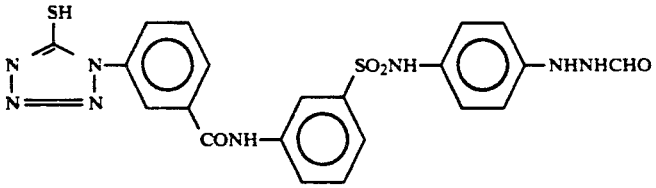
(I-16)
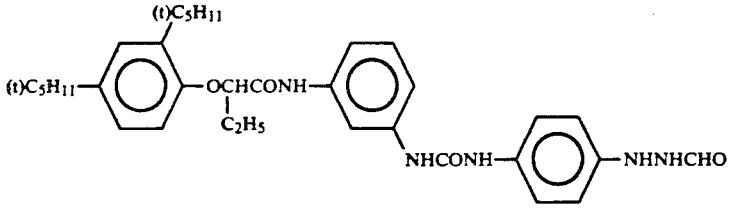
(I-17)
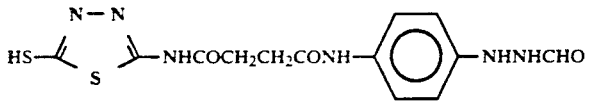
(I-18)
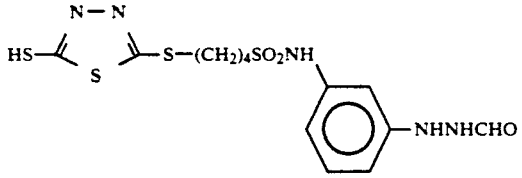
(I-19)
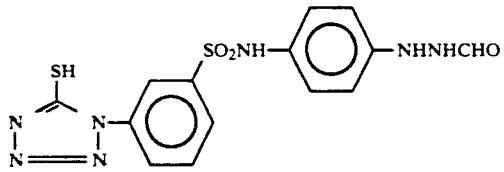
(I-20)
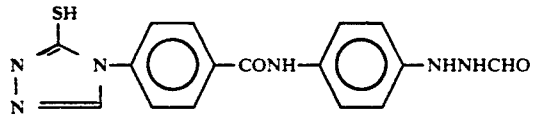
(I-21)
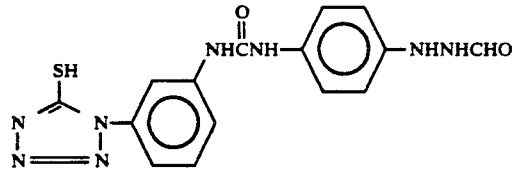
(I-22)
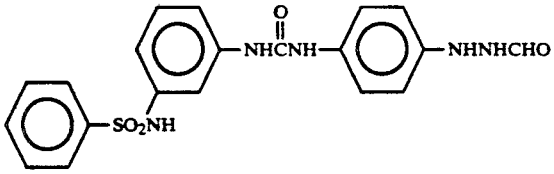
(I-23)
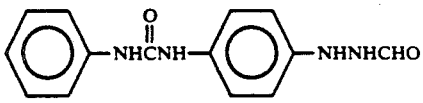

-continued
(I-24)
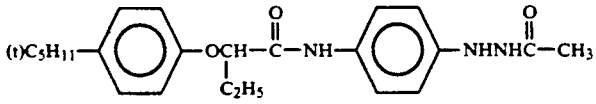
(I-25)
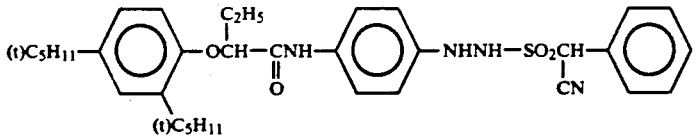
(I-26)
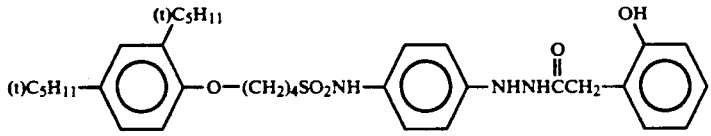
(I-27)
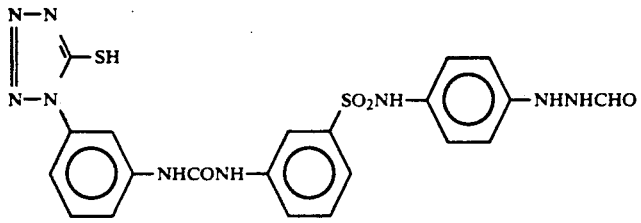
(I-28)
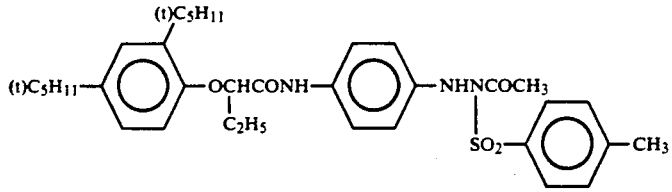
(I-29)
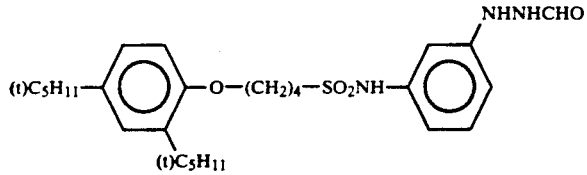
(I-30)
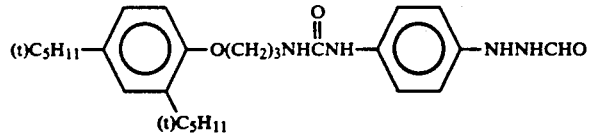
(I-31)
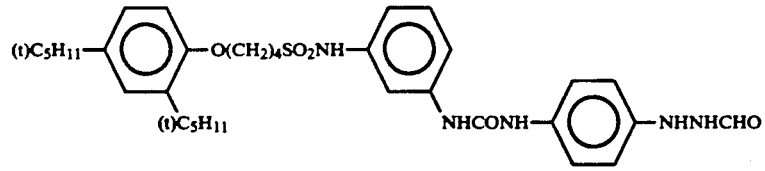
(I-32)
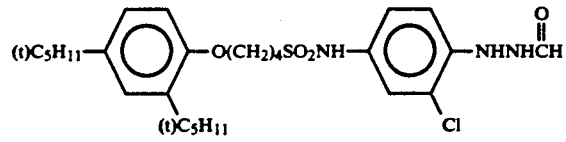

-continued
(I-33)
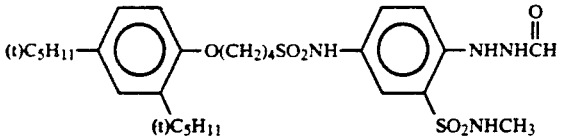
(I-34)
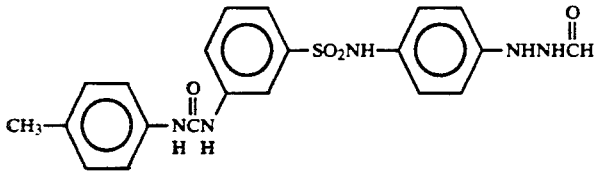
(I-35)
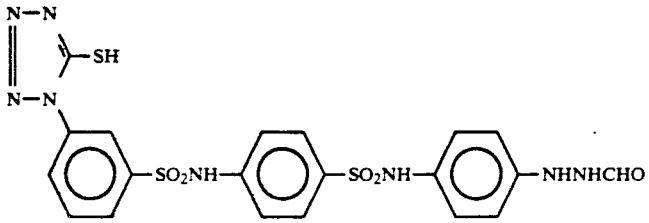
(I-36)
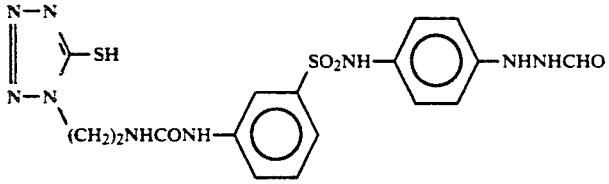
(I-37)
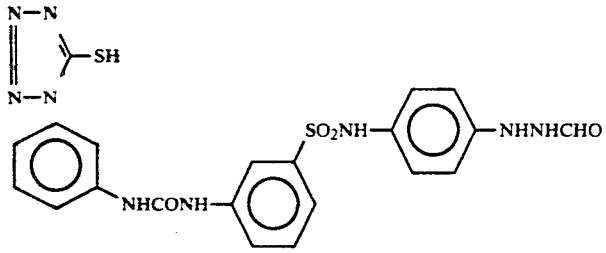
(I-38)
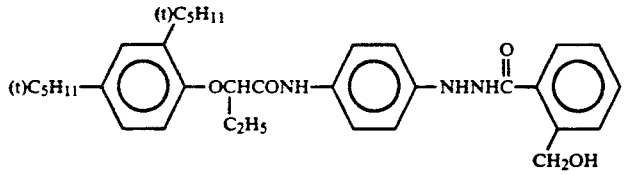
(I-39)
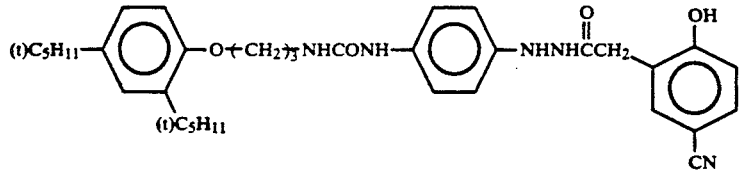
(I-40)
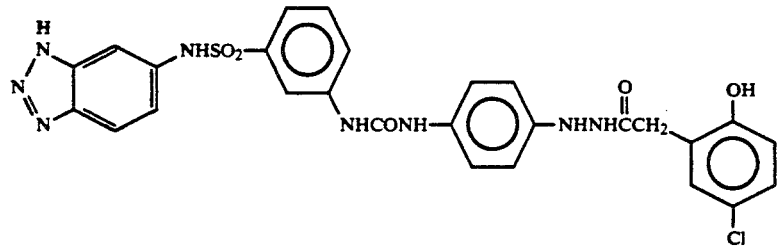

-continued
(I-41)
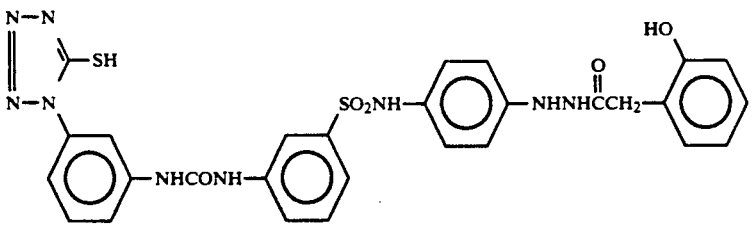
(I-42)
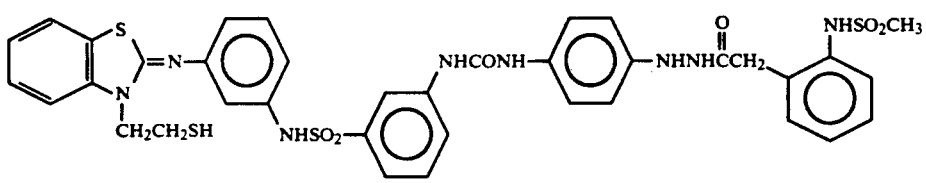
(I-43)
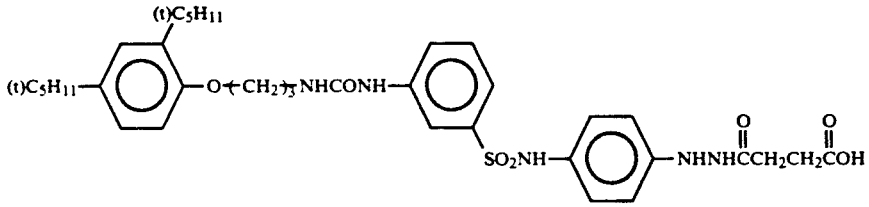
(I-44)
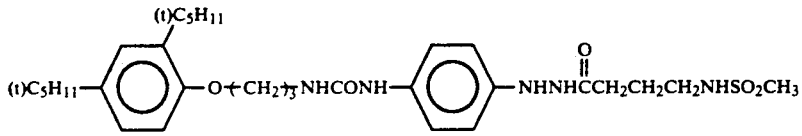
(I-45)
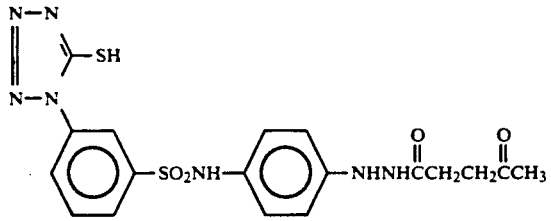
(I-46)
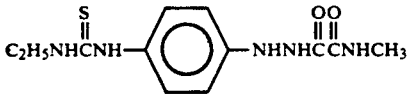
(I-47)
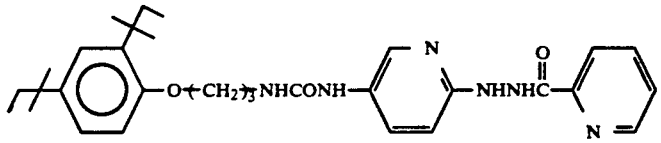
(I-48)
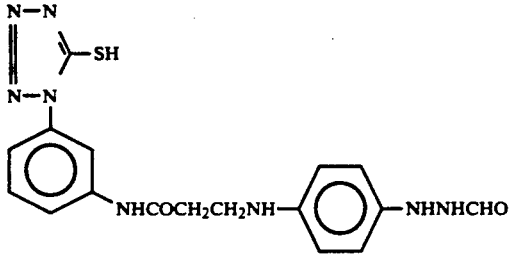

-continued
(I-49)
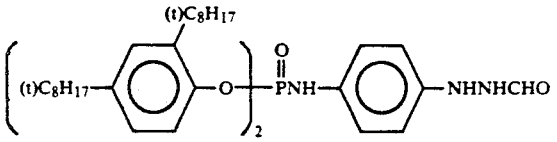
(I-50)
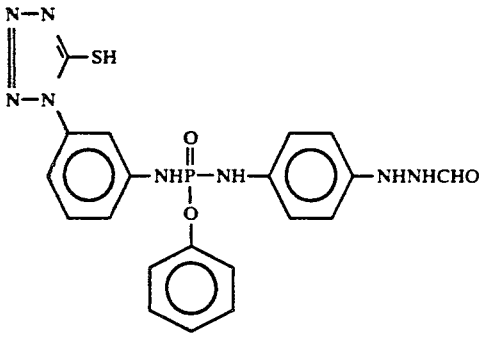
(I-51)
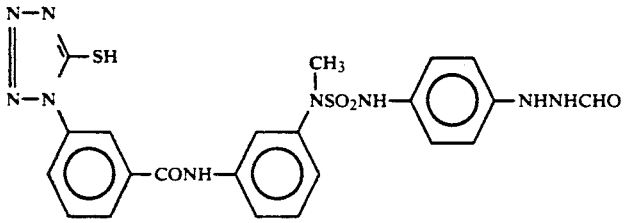
(I-52)
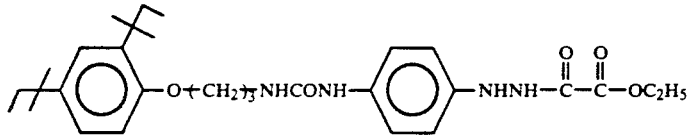
(I-53)
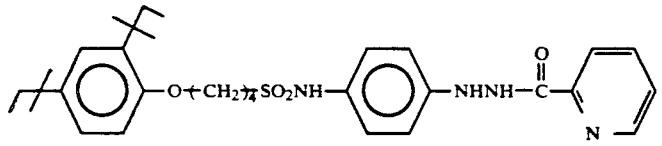
(I-54)
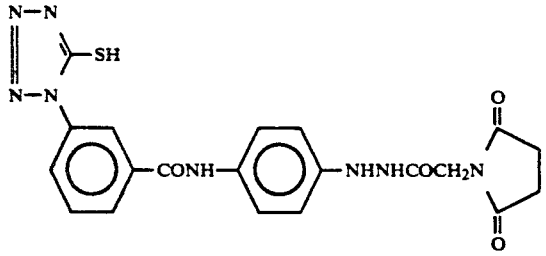
(I-55)
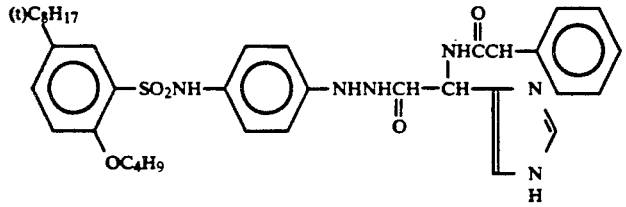

-continued

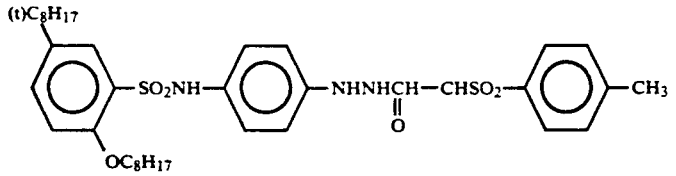

(I-56)

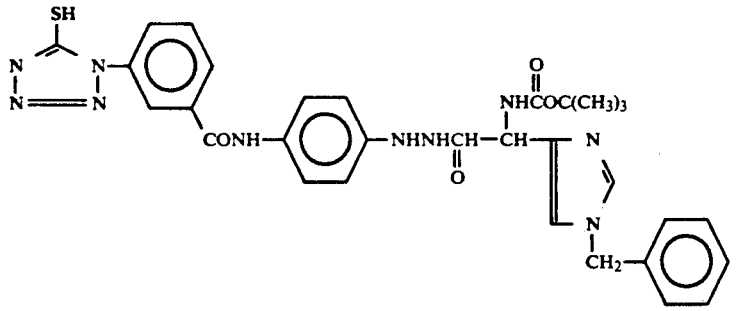

(I-57)

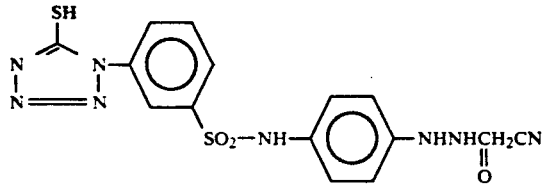

(I-58)

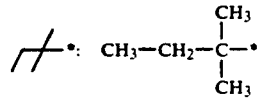

The hydrazine compounds which can be used in the present invention include, as well as those indicated above, those disclosed in *Research Disclosure*, Item 23516 (Nov., 983, p.346) and in the literature cited therein, and in U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, JP-A-62-948, EP 217,310, or U.S. Pat. No. 4,686,167, JP-A-62-178246, JP-A-63-32538, JP-A-63-104047, JP-A-63,121838, JP-A-63-129337, JP-A-63-223744, JP-A-63-234244, JP-A-63-234245,JP-A-63-234246,JP-A-63-294552,JP-A-63-306438, JP-A-1-100530, JP-A-1-105941, JP-A-1-105943, JP-A-64-10233, JP-A-1-90439, JP-A-1-276128, JP-A-1-283548, JP-A-1-280747, JP-A-283549, and JP-A-1-285940 and Japanese Patent Application Nos. 63-147339, 63-179760, 63-229163, 1-18377, 1-18378, 1-8379, 1-15755, 1-16814, 1-40792, 1-42615, 1-42616, 1-123693 and 1-126284.

The amount of hydrazine compound added in the present invention is preferably from $1\times10^{-6}$ mol to $5\times10^{-2}$ mol, and most preferably from $1\times10^{-5}$ mol to $2\times10^{-2}$ mol, per mol of silver halide.

Actual examples of the tetrazolium compounds which can be used in the present invention are indicated below, but the compounds which can be used in the present invention are not limited to these examples.

(1) 2-(Benzothiazol-2-yl)-3-phenyl-5-dodecyl-2H-tetrazolium bromide
(2) 2,3-Diphenyl-5-(4-tert-octyloxyphenyl)-2H-tetrazolium chloride
(3) 2,3,5-triphenyl-2H-tetrazolium
(4) 2,3,5-tri(p-carboxyethylphenyl)-2H-tetrazolium
(5) 2-(benzothiazol-2-yl)-3-phenyl-5-(o-chlorophenyl)-2H-tetrazolium
(6) 2,3-Diphenyl-2H-tetrazolium
(7) 2,3-Diphenyl-5-methyl-2H-tetrazolium
(8) 3-(p-Hydroxyphenyl)-5-methyl-2-phenyl-2H-tetrazolium
(9) 2,3-Diphenyl-5-ethyl-2H-tetrazolium
(10) 2,3-Diphenyl-5-n-hexyl-2H-tetrazolium
(11) 5-Cyano-2,3-diphenyl-2H-tetrazolium
(12) 2-(Benzothiazol-2-yl)-5-phenyl-3-(4-tolyl)-2H-tetrazolium
(13) 2-(Benzothiazol-2-yl)-5-(4-chlorophenyl)-3-(4-nitrophenyl)-2H-tetrazolium
(14) 5-Ethoxycarbonyl-2,3-di(3-nitrophenyl)-2H-tetrazolium
(15) 5-Acetyl-2,3-di(p-ethoxyphenyl)-2H-tetrazolium
(16) 2,5-Diphenyl-3-(p-tolyl)-2H-tetrazolium
(17) 2,5-Diphenyl-3-(p-iodophenyl)-2H-tetrazolium
(18) 2,3-Diphenyl-5-(p-diphenyl)-2H-tetrazolium
(19) 5-(p-Bromophenyl)-2-phenyl-3-(2,4,6-trichlorophenyl)-2H-tetrazolium
(20) 3-(p-Hydroxyphenyl)-5-(p-nitrophenyl)-2-phenyl-2H-tetrazolium
(21) 5-(3,4-Dimethoxyphenyl)-3-(2-ethoxyphenyl)-2-(4-methoxyphenyl)-2H-tetrazolium
(22) 5-(4-Cyanophenyl)-2,3-diphenyl-2H-tetrazolium
(23) 2,3-Di(4-methoxyphenyl)-5-nitro-2H-naphtho[1,2-d]-1,2,3-triazolium The non-diffusible compounds obtained by reacting the diffusible compounds among the above mentioned illustrative compounds with an anion can be used in those cases where the tetrazolium compounds used in the present invention are to be used as non-diffusible compounds.

The tetrazolium compounds which can be used in the present invention can be used individually, or a plurality of these compounds can be used conjointly.

The tetrazolium compounds used in the present invention are used in amounts from $1\times10^{-3}$ to $5\times10^{-2}$ mol per mol of silver halide.

The silver halide emulsions used in the present invention may be of any composition, such as silver chloride, silver chlorobromide, silver iodobromide or silver iodochlorobromide, for example.

The average grain size of the silver halide used in the present invention is preferably very fine (for example, not more than 0.7 μm), and a grain size of not more than 0.5 μm is most preferable. Fundamentally, no limitation is imposed upon the grain size distribution, but the use of monodispersions is preferred. Here, the term "monodispersion" signifies that the emulsion is comprised of grains such that at least 95% of the grains in terms of the number of grains or by weight are of a size within ±40% of the average grain size.

The silver halide grains in the photographic emulsion may have a regular crystalline form such as a cubic or octahedral form, or they may have an irregular crystalline form such as a spherical or plate-like form, or they may have a crystalline form which is a composite of these forms.

The silver halide grains may be such that the interior and surface layer are comprised of a uniform phase, or the interior and surface layer may be comprised of different phases. Use can also be made of mixtures of two or more types of silver halide emulsion which have been prepared separately.

Cadmium salts, sulfites, lead salts, thallium salts, rhodium salts or complex salts thereof, and iridium salts or complex salts thereof may be present during the formation or physical ripening of the silver halide grains in the silver halide emulsions used in the present invention.

The silver halide emulsions used in the present invention may or may not be chemically sensitized. Sulfur sensitization, reduction sensitization and precious metal sensitization methods are known for the chemical sensitization of silver halide emulsions, and chemical sensitizaton can be carried out using these methods either individually or in combinations.

Gelatin is useful as a binder or prtective colloid for photographic emulsions, but other hydrophilic colloids can be used for this purpose. For example, gelatin derivatives, graft polymer so fo ther polymers with gelatin, and proteins such as albumin and casein for example; cellulose derivatives such as hydroxyethylcellulose, carboxymethylcellulose and cellulose sulfate esters for example, sodium alginate, sugar derivatives such as starch derivatives, and many synthetic hydrophilic polymer substances such as poly(vinyl alcohol), partially acetalated poly(vinyl alcohol), poly (N-vinylpyrrolidone), poly(acrylic acid), poly(methacrylic acid), polyacrylamide, polyvinylimidazole and polyvinylpyrazole, for example, either as homopolymers or as copolymers, can be used for this purpose.

Acid treated gelatin cna be used as well as lime treated gelatin, and gelatin hydrolyzates and enzyme degradation products of gelatin can also be used.

Known spectrally sensitizing dyes may be added to the silver halide emulsion layer used in the present invention.

Various compounds can be included in the photographic emulsions used in the present invention with a view to preventing the occurrence of fogging during the manufacture, storage or photographic processing of the photographic material, or with a view to stabilizing photographic performance. Thus, many compounds which are known as antifogging agents or stabilizers, such as azoles, for example, benzothiazolium salts, nitroindazoles, triazoles, benzotriazoles, benzimidazoles (especially nitro or halogen substituted derivatives); heterocyclic mercapto compounds, for example, mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; heterocyclic mercapto compounds as indicated above which have water solubilizing groups such as carboxyl groups or sulfo groups; thioketo compounds, such as, oxazolinethione, for example; azaindenes, for example, tetra-azaindenes (especially 4-hydroxy substituted (1,3,3a,7)tetra-azaindenes); benzenethiosulfonic acids; benzenesulfinic acid and hydroquinones, for example, can be used for this purpose.

Inorganic or organic gelatin hardening agents can be included in the photographic emulsions or light-insensitive hydrophilic colloids of the present invention. For example, active vinyl compounds (for example, 1,3,5-triacryloylhexahydro-s-triazine, bis(vinylsulfonyl)-methyl ether, N,N'-methylenebis-[β-(vinylsulfonyl)propionamide]), active halogen compounds (for example, 2,4-dichloro-6-hydroxy-s-triazine), mucohalogen acids (for example, mucochloric acid), N-carbamoylpyridinium salts (for example, (1-morpholinocarbonyl-3-pyridinio)methanesulfonate) and haloamidinium salts (for example, 1-(1-chloro -1-pyridinomethylene)pyrrolidinium 2-naphthalenesulfonate) can be used individually or in combinations for this purpose. From among these, the active vinyl compounds disclosed in JP-A-53-41220, JP-A-53-57257, JP-A-59-162546 and JP-A-60-80846, and the active halogen compounds disclosed in U.S. Pat. No. 3,325,287, are preferred.

Various surfactants can be included for a variety of purposes in the photographic emulsion layers or other hydrophilic layers of the photographic materials made using the present invention, being used, for example, as coating promotors or as anti-static agents, with a view to improving slip properties, for emulsification and dispersion purposes, for the prevention of sticking and for improving photographic performance (for example, accelerating development, increasing contrast or increasing sensitivity).

For example, use can be made of non-ionic surfactants, such as saponin (steroid based), alkylene oxide derivatives (for example, polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkyl amines or amides, and poly(ethylene oxide) adducts of silicones), glycidol derivatives (for example, alkenylsuccinic acid polyglyceride, alkylphenol polyglyceride), fatty acid esters of polyhydric alcohols and sugar alkyl esters; anionic surfactants which include acidic groups, such as carboxylic acid groups, sulfo groups, phospho groups, sulfate ester groups and phosphate ester groups, for example, alkylcarboxylates, alkylsulfonates, alkylbenzenesulfonates, alkylnaphthalenesulfonates, alkylsulfate esters, alkylphosphate esters, N-acyl-N-alkyltaurines,sulfosuccinate esters,sulfoalkylpolyoxyethylene alkylphenyl ethers and polyoxyethylene alkylphosphate esters; amphoteric surfactants, such as amino acids, aminoalkylsulfonic acids, aminoalkyl sulfate or phosphate esters, alkylbetaines and amine oxides, and cationic surfactants, such as alkylamine salts, aliphatic and aromatic quaternary ammonium salts, heterocyclic quaternary ammonium salts, for example pyridinium salts and imidazolium salts, and phosphonium salts and sulfonium salts which contain aliphatic or heterocyclic rings.

Furthermore, polymer latexes, such as poly(alkyl acrylate) latexes, can be included for providing dimensional stability.

Cellulose triacetate, cellulose diacetate, nitrocellulose, polystyrene and polyesters, for example, can be used as supports for the photographic materials of the present invention.

Polyesters are comprised of aromatic dibasic acids and glycols as the principal components, and typical dibasic acids in this connection include terephthalic acid, isophthalic acid, p-$\beta$-oxyethoxybenzoic acid, diphenylsulfone dicarboxylic acid, diphenoxyethane dicarboxylic acid, adipic acid, sebacic acid, azelaic acid, 5-sodiumsulfo-isophthalic acid, diphenylene dicarboxylic acid and 2,6-naphthalene dicarboxylic acid, and examples of glycols include ethylene glycol, propylene glycol, butane diol, neopentylene glycol, 1,4-cyclohexane diol, 1,4-cyclohexanedimethanol, 1,4-bis(oxyethoxybenzene), bisphenol A, diethylene glycol and polyethylene glycol.

Poly(ethylene terephthalate) from among the polyesters which can be formed from these components is the most suitable in that it is easily procured.

No particular limitation is imposed on the thickness of the polyester, but a thickness of about 12 $\mu$m to 500 $\mu$m, and preferably of about 40 $\mu$m to 200 $\mu$m, enables the support to be handled easily and is advantageous for general purposes. Biaxially extended crystallized supports are especially advantageous in view of their stability and strength.

Moreover, the provision of a water vapor barrier layer comprised of a vinylidene chloride copolymer on both surfaces of the support is desirable.

The vinylidene chloride copolymers which can be used in the present invention include copolymers which contain from 70 to 99.5 wt %, and preferably from 85 to 99 wt %, of vinylidene chloride, the copolymers of vinylidene chloride, acrylic acid ester and a vinyl monomer which has an alcohol in a side chain disclosed in JP-A-51-135526, the copolymers of vinylidene chloride, alkyl acrylate and acrylic acid disclosed in U.S. Pat. No. 2,852,378, the copolymers of vinylidene chloride, acrylonitrile and itaconic acid disclosed in U.S. Pat. No. 2,698,235, and the copolymer of vinylidene chloride, alkyl acrylate and itaconic acid disclosed in U.S. Pat. No. 3,788,856. Actual examples of these compounds are indicated below. The numbers in brackets indicate the ratio by weight in all cases.

Vinylidene chloride : Methyl methacrylate : Hydroxyethyl acrylate copolymer (83 : 12 : 5)
Vinylidene chloride : Ethyl methacrylate : Hydroxypropyl acrylate copolymer (82 : 10 : 8)
Vinylidene chloride : Hydroxydiethyl methacrylate copolymer (92 : 8)
Vinylidene chloride : Methyl methacrylate : Acrylonitrile : Methacrylic acid copolymer (90 : 8 : 1 : 1)
Vinylidene chloride : Methyl methacrylate : Acrylonitrile copolymer (90 : 8 : 2)
Vinylidene chloride Butyl acrylate Acrylic acid copolymer (94 : 4 : 2)
Vinylidene chloride Butyl acrylate : Itaconic acid copolymer (75 : 20 : 5)
Vinylidene chloride : Methyl acrylate : Itaconic acid copolymer (90 : 8 : 2)
Vinylidene chloride : Methyl acrylate : Methacrylic acid copolymer (93 : 4 : 3)
Vinylidene chloride : Itaconic acid monoethyl ester copolymer (96 : 4)
Vinylidene chloride : Acrylonitrile : Acrylic acid copolymer (96 : 2.5 : 1.5)
Vinylidene chloride : Methyl acrylate : Acrylic acid copolymer (90 : 5 : 5)
Vinylidene chloride : Ethyl acrylate : Acrylic acid copolymer (92 : 5 : 3)
Vinylidene chloride : Methyl acrylate : 3-Chloro-2-hydroxypropyl acrylate copolymer (84 : 9 : 7)
Vinylidene chloride : Methyl acrylate : N-Ethanolacrylamide copolymer (85 : 10 : 5)

The surface of the polyester support can be subjected to a chemical treatment, a mechanical treatment, a corona discharge treatment, a flame treatment, an ultraviolet treatment, a high frequency treatment, a glow discharge treatment, an active plasma treatment, a high pressure steam treatment, a desorption treatment, a laser treatment, a mixed acid treatment or an ozone treatment, for example, in order to improve the strength of adhesion between the polyester support and the above mentioned polymer layer.

A thicker vinylidene chloride copolymer layer is preferred for preventing any expansion of the support due to the take-up of water during the development processing operations. However, problems arise with the adhesion of the silver halide emulsion layer when the vinylidene chloride copolymer layer is too thick.

Hence, the film thickness is set between at least 0.3 $\mu$m and not more than 5 $\mu$m, and use of a film of thickness within the range from 0.5 $\mu$m to 2.0 $\mu$m is preferred.

As well as the compounds disclosed, for example, in JP-A-53-77616, JP-A-54-37732, JP-A-53-137133, JP-A-60-140340 and JP-A-60-14959, various compounds which contain N or S atoms are effective as development accelerators or nucleation infectious development accelerators which are suitable for use in the present invention.

Stable development baths can be used to obtain superhigh contrast photographic characteristics using the silver halide photographic materials of the present invention and there is no need for the use of conventional infectious developers or the highly alkaline developers of pH approaching disclosed in U.S. Pat. No. 2,419,975.

That is to say, superhigh contrast negative images can be obtained satisfactorily with the silver halide photographic materials of the present invention using developers of pH 10.5–12.3, and preferably of pH 11.0–12.0, which contain at least 0.15 mol/liter of sulfite ion as a preservative.

No particular limitation is imposed upon the developing agents which can be used in the method of the present invention, and use can be made, for example, of dihydroxybenzenes (for example, hydroquinone), 3-pyrazolidones (for example, 1-phenyl-3-pyrazolidone, 4,4-dimethyl -1-phenyl-3-pyrazolidone), and aminophenols (for example, N-methyl-p-aminophenol), either individually or in combinations.

The silver halide photographic materials of the present invention are especially suitable for processing in developers which contain dihydroxybenzenes as the main developing agent and 3-pyrazolidones or aminophenols as auxiliary developing agents. The conjoint use of from 0.05 to 0.5 mol/liter of dihydroxybenzenes and not more than 0.06 mol/liter of 3-pyrazolidones or aminophenols in the developer is preferred.

The amino compounds disclosed in Japanese Patent Application No. 1-29418 can also be used in the developers which are used in the present invention. The specific examples of the amino compounds include 4-dimethylamino-1-butanol, 1-dimethylamino-2-butanol, 1-dimethylamino-2-hexanol, 5-dimethylamino-1-pentanol, 6-dimethylamino -1-hexanol, 1-dimethylamino-2-octanol, 6-dimethylamino-1,2-hexanediol, 8-dimethylamino -1-octanol,8-dimethylamino-1,2-octanediol and 10dimethylamino-1,2-decanediol, etc.

Furthermore, the development rate can be increased and the development time can be shortened by adding amines to the developer, as disclosed in U.S. Pat. No. 4,269,929.

Moreover, pH buffers, such as alkali metal sulfites, carbonates, borates and phosphates, and development inhibitors or anti-foggants, such as bromides, iodides and organic antifoggants (nitroindazoles and benzotriazoles are especially desirable), can also be included in the developer. Hard water softening agents, dissolution promotors, toners, development accelerators, surfactants (the aforementioned polyalkylene oxides are especially desirable), defoaming agents, film hardening agents, and agents for preventing silver contamination of the film (for example, 2-mercaptobenzimidazolesulfonic acids) can also be included, as required.

The fixing solutions useful for processing the silver halide photographic materials of the present invention are aqueous solutions which contain thiosulfate, water soluble aluminum compounds, acetic acid and dibasic acids (for example, tartaric acid, citric acid or salts of these acids), and the pH of the fixing solution is at least 4.4, preferably from 4.6 to 5.4, and most preferably from 4.6 to 5.0.

The pH of the fixing solution changes the degree of swelling of the film and has a marked effect on residual coloration. That is to say, if the pH exceeds 5.4 the film swells considerably even when the prescribed film hardening agents have been introduced and this can result in drying failure and feeding difficulties such as transport failures. If large amounts of film hardening agent are introduced to prevent these problems from arising the film is contaminated by the precipitation of the film hardening agents. On the other hand, residual coloration arises at pH values of 4.4 and below, and problems with fixing failure arise at pH values of 4.0 or below. However, with the pH range and amount of film hardening agent mentioned above in the present invention, films can be obtained rapidly with little residual coloration.

A thiosulfate, for example sodium thiosulfate or ammonium thiosulfate, is an essential component as a fixing agent, and the use of ammonium thiosulfate is especially desirable from the viewpoint of rapid fixing. The amount of fixing agent used can be varied appropriately, but it is enerally from about 0.1 mol/liter to about 5 mol/liter of the fixing solution.

Water soluble aluminum salts, chromium salts and trivalent iron compounds are used as acidic film hardening agents, and ethylenediamine tetra-acetic acid complexes are used as oxidizing agents, in the fixing solutions used in the present invention. The water soluble aluminum compounds are preferred, and examples of such compounds include aluminum chloride, aluminum sulfate and potassium alum. The amount used is preferably from 0.01 to 0.2 mol/liter, and most desirably from 0.03 to 0.08 mol/liter.

Tartaric acid or derivatives thereof, or citric acid or derivatives thereof, can be used individually as the dibasic acid aforementioned, or two or more such species can be used conjointly for this purpose. These compounds are effective when included in amounts of at least 0.005 mol per liter of fixing solution, and they are especially effective when used at concentrations of from 0.01 to 0.03 mol/liter.

Actual examples of compounds which can be used include tartaric acid, potassium tartrate, sodium tartrate, potassium hydrogen tartrate, sodium hydrogen tartrate, potassium sodium tartrate, ammonium tartrate, potassium ammonium tartrate, potassium aluminum tartrate, potassium antimonyl tartrate, sodium antimonyl tartrate, lithium hydrogen tartrate, lithium tartrate, magnesium hydrogen tartrate, potassium boron tartrate and potassium lithium tartrate.

Examples of citric acid and derivatives thereof which are effective in the present invention include citric acid, sodium citrate, potassium citrate, lithium citrate and ammonium citrate.

Preservatives (for example, sulfites and bisulfites), pH buffers (for example, acetic acid and boric acid), pH adjusting agents (for example, sulfuric acid) and chelate compounds can be included, as required, in the fixing solution. The pH buffers are used in amounts of from 10 to 40 grams/liter, and preferably in amounts of from 18 to 25 grams/liter, because of the high pH of the developer.

The chelate compounds which can be used in the present invention must have stability constant of from 6.0 or more, preferably 7 to 11.

The stability constant is defined in Ueno, *Method of Chelatometric Titration*, 17edition of a second revision, page 18, (1979), published by Nankodo. Further, the stability constants of various chelate compounds which can be used in the present invention are described in *General catalogue of Dotite reagent*, 12th edition, (1980), published by Dojin Kagaku Kenkyusho.

Specific examples of the chelate compounds which can be used in the present invention include alkali metal salts of the following compounds, but the invention is not limited to these compounds.

Trans-1,2-cyclohexanediamine-N,N,N',N'-tetraacetic acid (CYDTA) (log $K_{ML}$ 10.3)

1,2-Diaminopropane-N,N,N',N'-tetraacetic acid (methyl EDTA) (log $K_{ML}$ 8.8)

Ethylenediamine tetraacetic acid (EDTA) (log $K_{ML}$ 8.7)

Triethylenetetramine-N,N,N',N''.N''', N'''-hexaacetic acid (TTHA) (log $K_{ML}$ 8.1)

Diethylenetriamine-N,N,N',N'',N''-pentaacetic acid (DTPA) (log $K_{ML}$ 9.3)

The fixing temperature and time fall within the same ranges as those used for development, and fixing times of from 10 seconds to 1 minute at a temperature of from about 20° C. to about 50° C. are preferred.

In accordance with the method of the present invention, the developed and fixed photographic material is washed with water and dried. The water washing is carried out until the silver salts which have been rendered soluble by the fixing have been more or less completely removed, and a washing time of from 10 seconds to 3 minutes at a temperature of from about 20° C. to about 50° C. is preferred. Drying is carried out at a temperature of from about 40° C. to about 100° C. The drying time can be varied appropriately according to the ambient conditions, but a drying time of from about 5 seconds to about 3 minutes 30 seconds is usually preferred.

Roller transport type automatic processors have been disclosed, for example, in the specifications of U.S. Pat. Nos. 3,025,779 and 3,545,971, and in the present specification such devices are referred to simply as roller transport type processors. A roller transport type processor executes the four operations of development, fixing, water washing and drying, but other processes (for example a stop process) are not precluded from the method of the present invention. However, the use of these four processes is most desirable.

The development process temperature and the fixing process temperature are normally selected from 18° C. to 50° C., and preferably they are from 25° C. to 43° C.

The photographic material of the present invention is especially suited to rapid development processing with an automatic processor. Roller transport processors, belt transport processors and other types of processors may be used. The processing time should be short, with a total time of not more than 2 minutes and preferably not more than 100 seconds, and satisfactory results are obtained with rapid processing in which the time taken for development accounts for from 5 to 60 seconds, or in which the fixing time is from 5 to 40 seconds and the water washing time is from 5 to 60 seconds.

The compounds disclosed in JP-A-56-24347 can be used in the developer in the practice of the present invention as agents for preventing silver contamination. The compounds disclosed in JP-A-61-267759 can be used as dissolution promotors which are added to the developer. Moreover, the compounds disclosed in JP-A-60-93433 or the compounds disclosed in JP-A-62-186256 can be used as pH buffers in the developer.

It is possible by means of the present invention to obtain silver halide photographic materials which provide superhigh contrast when used with stable developers and with which the formation of pinholes is unlikely.

The invention is described in detail below by means of illustrative examples, which are not intended to limit the invention. In the following examples, a compound represented by a number (e.g. Compound 7) represents the same compound in each example where it appears.

Moreover, the formulations of the developer and fixer used in the illustrative examples are indicated below.

| Developer | | |
|---|---|---|
| Hydroquinone | 50.0 | grams |
| N-Methyl-p-aminophenol | 0.3 | gram |
| Sodium hydroxide | 18.0 | grams |
| 5-Sulfosalicylic acid | 30.0 | grams |
| Boric acid | 20.0 | grams |
| Potassium sulfite | 110.0 | grams |
| Ethylenediamine tetra-acetic acid, sodium salt | 1.0 | gram |
| Potassium bromide | 10.0 | grams |
| 5-Methylbenzotriazole | 0.4 | grams |
| 2-Mercaptobenzimidazole-5-sulfonic acid | 0.3 | gram |
| 3-(5-Mercaptotetrazole)benzenesulfonic acid, sodium salt | 0.2 | gram |
| 6-Dimethylamino-1-hexanol | 4.0 | grams |
| Sodium toluenesulfonate | 15.0 | grams |
| Water to make up to | 1 | liter |

pH adjusted 11.7 (by adding potassium hydroxide)

| Film Hardening Fixing Solution | | |
|---|---|---|
| Ammonium thiosulfate | 180 | grams |
| Sodium thiosulfate, penta-hydrate | 45 | grams |
| Sodium sulfite | 18 | grams |
| Ethylenediamine tetra-acetic acid | 0.4 | gram |
| Tartaric acid | 4.0 | gram |
| Glacial acetic acid | 30.0 | grams |
| Aluminum sulfate | 11.0 | grams |
| Water to make up to | 1 | liter |

pH adjusted to 4.7 with ammonia

EXAMPLE 1

An undercoating layer comprising 14 mg/m$^2$ of gelatin and 9 mg/m$^2$ of the reaction product of epichlorhydrin and a polyamide derived from diethylenetriamine and adipic acid was coated on both sides of a biaxially extended poly(ethylene terephthalate) support of thickness 100 μm. Next, an electrically conductive layer of formulatioon (1) as indicated below and a gelatin layer of formulation (2) as indicated below were coated onto one side of the support. Next, a backing layer and a protective layer 1 of formulations (3) and (4), respectively, were coated sequentially over the top of the gelatin layer.

| | |
|---|---|
| Formulation (1) Electrically Conductive Layer | |
| $SnO_2$/Sb (9/1 by weight, average particle size 0.25 μm) | 165 mg/m$^2$ |
| Gelatin | 19 mg/m$^2$ |
| Formulation (2) Gelatin Layer | |
| Gelatin | 35 mg/m$^2$ |
| Salicylic acid | 17 mg/m$^2$ |
| Reaction product of epichlorhydrin and a polyamide composed of diethylenetriamine and adipic acid | 6 mg/m$^2$ |
| Formulation (3) Backing Layer | |
| Gelatin | 2.5 g/m$^2$ |
| Compound 1 | 300 mg/m$^2$ |

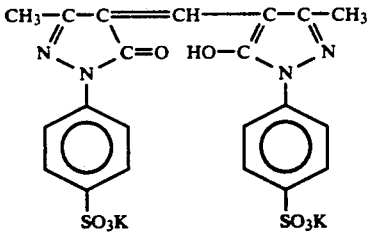

Compound 2 50 mg/m$^2$

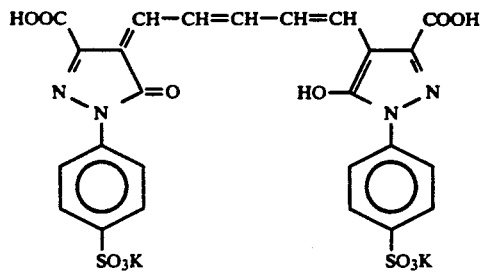

Compound 3 50 mg/m$^2$

-continued

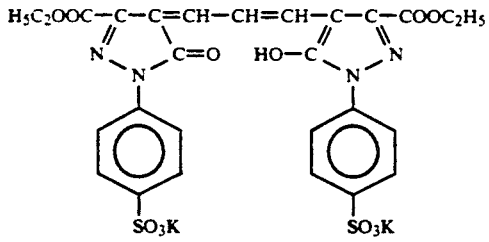

| | |
|---|---|
| Compound 7 | 10 mg/m$^2$ |
| Sodium dodecylbenzenesulfonate | 50 mg/m$^2$ |
| Sodium di-benzyl-α-sulfosuccinate | 20 mg/m$^2$ |
| Poly(sodium styrenesulfonate) | 40 mg/m$^2$ |
| 1,3-Divinylsulfonyl-2-propanol | 150 mg/m$^2$ |
| Ethyl acrylate latex (average particle size 0.05 μm) | 500 mg/m$^2$ |

Formulation (4) Protective Layer 1

| | |
|---|---|
| Gelatin | 1 g/m$^2$ |
| Silicon dioxide matting agent (average particle size 3.5 μm, pore diameter 25 Å, surface area 700 m$^2$/gram | 30 mg/m$^2$ |
| Sodium dodecylbenzenesulfonate | 15 mg/m$^2$ |
| Sodium dihexyl-α-sulfosuccinate | 10 mg/m$^2$ |
| Poly(sodium styrenesulfonate) | 20 mg/m$^2$ |
| Sodium acetate | 40 mg/m$^2$ |

Moreover, silver halide emulsion layers 1 and 2 and protective layers 2 and 3 of formulations (5), (6), (7) and (8) indicated below were coated sequentially onto the other surface of the support. Matting agent was added to protective layer 3 as shown in Table 1.

Formulation (5) Silver Halide Emulsion Layer 1

Liquid I: 300 ml of water, 9 grams of gelatin
Liquid II: 100 grams of $AgNO_3$, 400 ml of water
Liquid III: 37 grams of NaCl, 1.1 ml of $(NH_4)_3RhCl_6$ and 400 ml of water Liquid II and Liquid III were added simultaneously at a constant rate to Liquid I which was being maintained at 45° C. The soluble salts were subsequently removed from the emulsion in the usual way well known in the industry (i.e., flocculation method), after which gelatin was added, and then 6-methyl-4-hydroxy-1,3,3a,7-tetra-azaindene was added as a stabilizer. The average grainsize of this mono-disperse emulsion was 0.20 μm and the gelatin content was 60 grams per kg of recovered emulsion.

The compounds indicated were added to the emulsion so obtained.

| | |
|---|---|
| Illustrative Compound (I-30) of general formula (I) | 6 × 10$^{-3}$ mol/mol · Ag |
| Compound 4 | 60 mg/m$^2$ |
| Compound 5 | 9 mg/m$^2$ |
| Compound 7 | 10 mg/m$^2$ |
| Poly(sodium styrenesulfonate) | 40 mg/m$^2$ |
| N-Oleoyl-N-methyltaurine, sodium salt | 50 mg/m$^2$ |
| 1,2-Bis(vinylsulfonylacetamido)ethane | 70 mg/m$^2$ |
| 1-Phenyl-5-mercaptotetrazole | 3 mg/m$^2$ |
| Ethyl acrylate latex (average particle size 0.05 μm) | 0.46 g/m$^2$ |

The coating liquid so obtained was coated in such a way as to provide a coated silver weight of 1.3 g/m$^2$.

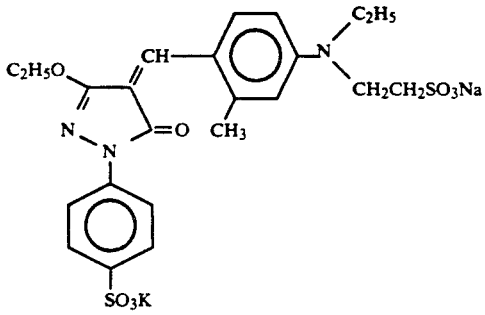

Compound 5

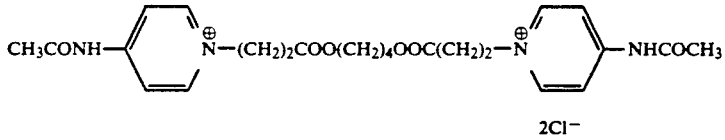

Formulation (6) Silver Halide Emulsion Layer 2

Liquid I: 300 ml of water, 9 grams of gelatin
Liquid II: 100 grams of $AgNO_3$, 400 ml of water
Liquid III: 37 grams of NaCl, 2.2 mg of $(NH_4)_3RhCl_6$ and 400 ml of water Liquid II and Liquid III were added simultaneously to Liquid I in the same way as when preparing the emulsion of formulation (5). The average grain size of this mono-disperse emulsion was 0.20 μm.

The compounds indicated were added to the emulsion so obtaned.

| | |
|---|---|
| Emulsified dispersion of a hydrazine compound, Illustrative Compound (I-30) of general formula (I) | 5 × 10$^{-3}$ mol/mol · Ag |
| Compound 4 | 60 mg/m$^2$ |
| Compound 5 | 9 mg/m$^2$ |
| Compound 7 | 10 mg/m$^2$ |
| Poly(sodium styrenesulfonate) | 50 mg/m$^2$ |
| N-Oleoyl-N-methyltaurine, sodium salt | 40 mg/m$^2$ |
| 1,2-Bis(vinylsulfonylacetamido)ethane | 80 mg/m$^2$ |
| 1-Phenyl-5-mercaptotetrazole | 3 mg/m$^2$ |
| Ethyl acrylate latex (average particle size 0.05 μm) | 0.40 g/m$^2$ |

The coating liquid obtained in this way was coated in such a way as to provide a coated silver weight of 1.3 g/m$^2$.

| Formulation (7) Protective Layer 2 | |
|---|---|
| Gelatin | 1.0 g/m$^2$ |
| Lipoic acid | 5 mg/m$^2$ |
| Sodium dodecylbenzenesulfonate | 5 mg/m$^2$ |
| Compound 8 | 20 mg/m$^2$ |
| Poly(sodium styrenesulfonate) | 10 mg/m$^2$ |
| Compound 9 | 20 mg/m$^2$ |
| Ethyl acrylate latex (average particle size 0.05 μm) | 200 mg/m$^2$ |

| Formulation (8) Protective Layer 3 | |
|---|---|
| Gelatin | 1.0 g/m$^2$ |
| Matting agent (Table 1) | 50 mg/m$^2$ |
| Sodium dodecylbenzenesulfonate | 20 mg/m$^2$ |
| Perfluoroctane sulfonic acid potassium salt | 10 mg/m$^2$ |
| N-Perfluorooctanesulfonyl-N-propylglycine, potassium salt | 3 mg/m$^2$ |
| Poly(sodium styrenesulfonate) | 2 mg/m$^2$ |
| Poly(degree of polymerization 5)oxyethylene nonylphenyl ether sulfate ester, sodium salt | 20 mg/m$^2$ |

Preparation of the Emulsified Dispersion of the Hydrazine Compound

| Liquid I | |
|---|---|
| Illustrative compound (I-30) | 3.0 grams |
| Compound 6 | 1.5 grams |
| Poly(N-tert-butylacrylamide) | 6.0 grams |
| Ethyl acetate | 30 ml |
| Sodium dodecylbenzenesulfonate (72% methanolic solution) | 0.12 grams |
| Water | 0.12 ml |

These materials were heated to 65° C. to form a uniform solution which was taken as Liquid I.

| Liquid II | |
|---|---|
| Gelatin | 12 grams |

-continued

| Liquid II | |
|---|---|
| Compound 7 | 0.02 grams |
| Water | 108 ml |

These materials were heated to 65° C. to form a uniform solution which was taken as Liquid II.

Liquids I and II were mixed together and subjected to high speed agitation in a homogenizer (made by Nippon Seiki Seisakujo) and a fine particle emulsified dispersion was obtained. The ethyl acetate was removed from the emulsion so obtained by heating and distillation under reduced pressure, after which water was added to make up to a total of 250 grams. The residual ethyl acetate content was 0.2%.

Compound 6

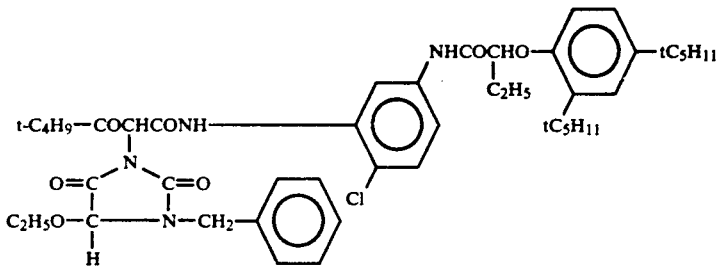

Compound 7

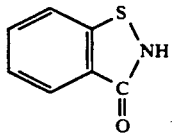

Compound 8

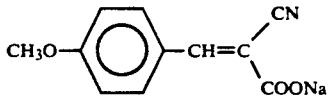

Compound 9

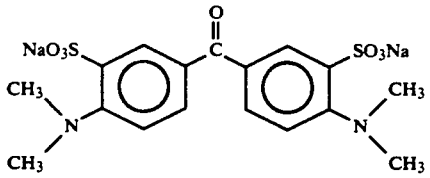

The samples obtained in this way were left to stand for 10 days under conditions of 25° C., 60% RH, after which they were evaluated in respect of the extent of pinhole formation and vacuum contact properties using the methods outlined below.

(1) Evaluation of the Extent of Pinhole Formation

The samples were exposed in such a way as to provide an optical density of 4.0 and then developed at 38° C. for 20 seconds in an FG-660F automatic processor (made by the Fuji Photo Film Co., Ltd.) using the developer and film hardening fixing solution described earlier, after which the samples were examined on a high illuminance (3000 lx) light table in respect of the extent of pinhole formation.

(2) Evaluation of Vacuum Contact Properties

An original film (35 cm×45 cm) was laminated with the sample (40 cm×50 cm) in a printer for contact exposures using an original film with a screened image with average 10% dots and the two materials were brought into contact using a vacuum of −650 mm·Hg. After exposure, the sample was developed and processed in the same way as in (1) above, and the time for which the vacuum had to be applied to provide a uniform screen dot image with 90% dots was obtained. A shorter vacuum suction time indicated better vacuum contact properties.

The results obtained were as shown in Table 1.

TABLE 1

| Sample Number | Silicon Dioxide Matting Agent: Average Grain Size* (μm) | Pore Diameter** (Å) | Surface Area** ($m^2/g$) | (1) Extent of Pinhole Formation*** | (2) Vacuum Contact Properties (sec.) |
|---|---|---|---|---|---|
| 1 (Comp. Ex.) | 3.5 | 170 | 300 | 100 | 45 |
| 2 (Invention) | 3.5 | 100 | 450 | 60 | 43 |
| 3 (Invention) | 3.5 | 50 | 550 | 45 | 42 |
| 4 (Invention) | 3.5 | 29 | 640 | 30 | 42 |
| 5 (Invention) | 3.5 | 25 | 700 | 20 | 41 |
| 6 (Invention) | 2.5 | 25 | 700 | 18 | 90 |

*Coal tar counter method.
**Gas adsorption method
***Relative values taking the rate of occurrence for Sample 1 to be 100.

It is clear from Table 1 that Samples 2 - 5 of the present invention had good vacuum contact properties and were markedly less liable to pinhole formation.

EXAMPLE 2

The backing layer and the protective layer 1 of formulations (9) and (10), respectively, indicated below were coated on one side of a biaxially extended poly(ethylene terephthalate) support of thickness 100 μm which had an undercoating layer on both sides, the silver halide emulsion layer of formulation (11) indicated below was coated in such a way as to provide a coated silver weight of 2.7 $g/m^2$ on the other side of the support, and the protective layers 2 and 3 of formulations (12) and (13) were coated sequentially over this layer.

Matting agents were added to the protective layer 3 as shown in Table 2.

Formulation (9) Backing Layer

| | |
|---|---|
| Gelatin | 3 $g/m^2$ |
| Compound 11 | 40 $mg/m^2$ |

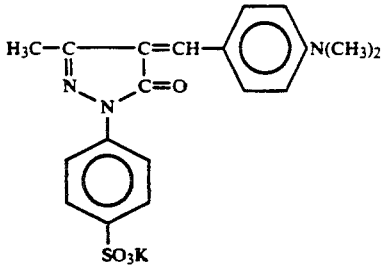

| | |
|---|---|
| Compound 1 | 120 $mg/m^2$ |
| Compound 2 | 40 $mg/m^2$ |
| Compound 3 | 30 $mg/m^2$ |
| Sodium dihexyl-α-sulfosuccinate | 40 $mg/m^2$ |
| Sodium dodecylbenzenesulfonate | 40 $mg/m^2$ |
| 1,3-Divinylsulfonyl-2-propanol | 120 $mg/m^2$ |

Formulation (10) Protective Layer 1

| | |
|---|---|
| Gelatin | 0.8 $mg/m^2$ |
| Poly(methyl methacrylate) fine particles (average particle size 3.4 μm) | 30 $mg/m^2$ |
| Sodium dihexyl-α-sulfosuccinate | 15 $mg/m^2$ |
| Sodium dodecylbenzenesulfonate | 15 $mg/m^2$ |
| Sodium acetate | 40 $mg/m^2$ |

Formulation (11) Silver Halide Emulsion Layer

Liquid I: 300 ml of water, 7.2 grams of gelatin
Liquid II: 100 grams of $AgNO_3$, 400 ml of water
Liquid III: 69.7 grams of KBr, 0.49 gram of KI, 0.123 mg of $K_3IrCl_6$ and 500 ml of water Liquid II and Liquid III were added simultaneously at a constant rate to Liquid I which was being maintained at 50° C. The soluble salts were subsequently removed from the emulsion in the usual way well known in the industry, after which gelatin was added. The average grain size of this mono disperse emulsion was 0.28 μm and the gelatin content was 56 grams per kg of recovered emulsion.

The compounds indicated were added to the emulsion so obtained.

| | |
|---|---|
| 5,5'-Dichloro-9-ethyl-3,3'-bis(3-sulfopropyl)oxacarbocyanine, sodium salt | 11 $mg/m^2$ |
| 3-(3-Sulfopropyl)-3'-(4-sulfobutyl)-5'-phenyl-4,5-dibenzoxacyanine, sodium salt | 6.9 $mg/m^2$ |
| 6-Methyl-4-hydroxy-1,3,3a,7-tetra-azaindene | 8 $mg/m^2$ |
| 5-Methylbenzotriazole | 17 $mg/m^2$ |
| Compound 4 of Example 1 | 5 $mg/m^2$ |
| Compound I-5 of general formula (I) | $1.2 \times 10^{-3}$ mol/mol · Ag |
| Compound I-19 of general formula (I) | $5 \times 10^{-3}$ mol/mol · Ag |
| Polymer latex | 195 $mg/m^2$ |

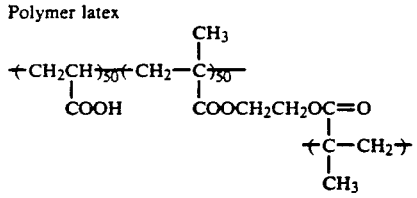

| | |
|---|---|
| Ethyl acrylate latex (average particle size 0.05 μm) | 600 $mg/m^2$ |
| 1,2-Bis(vinylsulfonylacetamido)ethane | 140 $mg/m^2$ |
| Sodium N-oleoyl-N-methyltaurine | 40 $mg/m^2$ |
| Poly(sodium styrenesulfonate) | 20 $mg/m^2$ |

Formulation (12) Protective Layer 2

| | |
|---|---|
| Gelatin | 1.0 $g/m^2$ |
| Ascorbic acid | 30 $mg/m^2$ |
| Hydroquinone | 190 $mg/m^2$ |
| Ethyl acrylate latex (average particle size 0.05 μm) | 240 $mg/m^2$ |
| Poly(sodium styrenesulfonate) | 3 $mg/m^2$ |
| 2,4-Dichloro-6-hydroxy-1,3,5-triazine, sodium salt | 12 $mg/m^2$ |

Formulation (13) Protective Layer 3

| | |
|---|---|
| Gelatin | 0.6 $g/m^2$ |
| Matting agent | (Table 2) |
| Liquid organopolysiloxane | 10 $mg/m^2$ |
| Sodium dodecylbenzenesulfonate | 20 $mg/m^2$ |
| N-Perfluorooctanesulfonyl-N-propylglycine, potassium salt | 4 $mg/m^2$ |

-continued

| | |
|---|---|
| Colloidal silica | 90 mg/m$^2$ |

The samples so obtained were evaluated in respect of the extent of pinhole formation and vacuum contact properties in the same way as in Example 1. The results obtained are shown in Table 2.

TABLE 2

| Sample Number | Silicon Dioxide Matting Agent: Composition | Average Particle Size (μm) | Pore Diameter (Å) | Surface Area (m$^2$/g) | Amount Coated (mg/m$^2$) | (1) Extent of Pinhole Formation* | (2) Vacuum Contact Properties (sec.) |
|---|---|---|---|---|---|---|---|
| 7 (Invention) | Silicon dioxide | 3.5 | 25 | 700 | 50 | 25 | 40 |
| 8 (Invention) | Silicon dioxide | 3.5 | 50 | 550 | 50 | 50 | 42 |
| 9 (Comp. Ex.) | Silicon dioxide | 3.5 | 170 | 300 | 50 | 100 | 46 |
| 10 (Comp. Ex.) | Poly(methyl methacrylate | 3.5 | Not Porous | | 50 | 130 | 46 |
| 11 (Comp. Ex.) | Poly(methyl methacrylate | 2.5 | Not Porous | | 50 | 25 | 100 |

*Relative values taking rate of occurrence for Sample 9 to be 100.

It is clear from Table 2 that Samples 7 and 8 of the present invention had good vacuum contact properties and exhibited remarkably few pinholes. Furthermore, comparative Sample 10 in which a non-porous poly(-methyl methacrylate) matting agent was used was clearly more liable to pinhole formation than comparative Sample 9.

EXAMPLE 3

The backing layer and the protective layer 1 of formulations (14) and (15) indicated below were coated on one side of a biaxially extended poly(ethylene terephthalate) support of thickness 100 μm which had an undercoating layer on both sides, the silver halide emulsion layer of formulation (16) indicated below was coated in such a way as to provide a coated silver weight of 2.8 g/m$^2$ on the other side of the support, and the protective layers 2 and 3 of formulations (17) and (18) indicated below were coated sequentially over this layer. Matting agents were added to the protective layer 3 as shown in Table 3.

| Formulation (14) Backing Layer | |
|---|---|
| Gelatin | 2.5 g/m$^2$ |
| Compound 1 | 0.26 mg/m$^2$ |
| Compound 2 | 30 mg/m$^2$ |
| Compound 3 | 40 mg/m$^2$ |
| Compound 8 | 90 mg/m$^2$ |
| Sodium dihexyl-α-sulfosuccinate | 30 mg/m$^2$ |
| Sodium dodecylbenzenesulfonate | 35 mg/m$^2$ |
| 1,3-Divinylsulfonyl-2-propanol | 130 mg/m$^2$ |
| Ethyl acrylate latex (average particle size 0.05 μm) | 0.5 mg/m$^2$ |

| Formulation (15) Protective Layer 1 | |
|---|---|
| Gelatin | 0.8 g/m$^2$ |
| Poly(methyl methacrylate) fine particles (average particle size 3.4 μm) | 40 mg/m$^2$ |
| Sodium dihexyl-α-sulfosuccinate | 9 mg/m$^2$ |
| Sodium dodecylbenzenesulfonate | 10 mg/m$^2$ |
| Sodium acetate | 40 mg/m$^2$ |

Formulation (16) Silver Halide Emulsion Laver

An aqueous solution of silver nitrate and an aqueous solution of sodium chloride which contained $1.3\times10^{-4}$ mol/mol·Ag of the ammonium salt of hexachlororhodium(III) acid were added simultaneously over a period of 10 minutes to an aqueous gelatin solution which was being maintained at a temperature of 35° C., and monodisperse cubic silver chloride grains of average grain size 0.08 μm were prepared by controlling the potential at this time to 200 mV. After forming the grains, the soluble salts were removed using the flocculation method well known in the industry, and 4-hydroxy-6-methyl-1,3,3a,7-tetra-azaindene and 1-phenyl-5- mercaptotetrazole were added as stabilizers.

Compounds (I-19) and (I-5) which can be represented by general formula (I) of the present invention were added at the rates of $1\times10^{-4}$ mol/mol·Ag and $1\times10^{-3}$ mol/mol·Ag respectively to the emulsion as contrast enhancers, compound 12 was added at the rate of 35 mg/m$^2$, 50 wt. % with respect to the gelatin in terms of solid fraction of a poly(ethyl acrylate) latex, and 145 mg/m$^2$of 2-bis (vinylsulfonylacetamido)ethane as a hardener were added to the emulsion.

| Formulation (17) Protective Layer 2 | |
|---|---|
| Gelatin | 1 g/m$^2$ |
| Thioctic acid | 6 mg/m$^2$ |
| Compound 13 | 90 mg/m$^2$ |
| 1,5-Dihydroxy-2-benzaldoxime | 35 mg/m$^2$ |
| Sodium dodecylbenzenesulfonate | 10 mg/m$^2$ |
| Poly(sodium styrenesulfonate) | 20 mg/m$^2$ |
| Ethyl acrylate latex (average particle size 0.05 μm) | 0.2 g/m$^2$ |

| Formulation 18 Protective Layer 3 | |
|---|---|
| Gelatin | 0.6 g/m$^2$ |
| Compound 14 | 0.1 g/m$^2$ |
| Matting agent | (Table 3) |
| N-Perfluorooctanesulfonyl-N-propyl-glycine, potassium salt | 3 mg/m$^2$ |
| Sodium dodecylbenzenesulfonate | 20 mg/m$^2$ |

Moreover, compound 14 was formed into a gelatin emulsion using the procedure indicated below and added to the formulation.

A solution obtained by dissolving 18.9 grams of compound 14 in 25 ml of N,N-dimethylsulfoamide was mixed with stirring at 45° C. with 536 grams of a 6.5 wt. % aqueous gelatin solution to which 13 grams of compound 15 has been added and a dispersion was obtained.

Compound 12

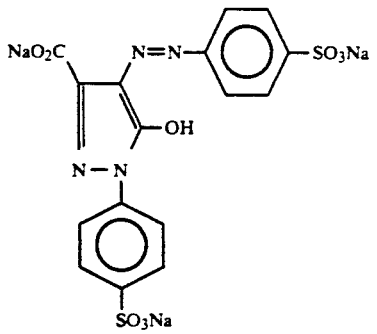

Compound 13

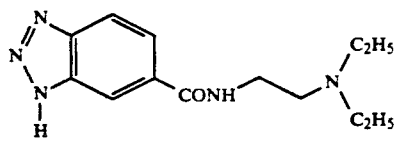

Compound 14

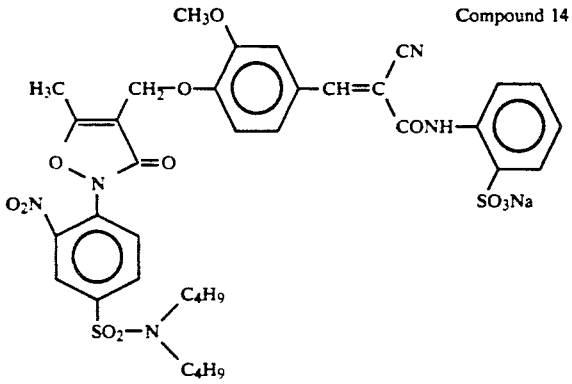

Compound 15

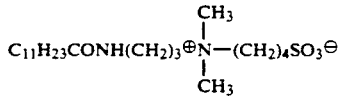

The samples obtained were evaluated in respect of the extent of pinhole formulation and vacuum contact properties in the same way as in Example 1. The results obtained are shown in Table 3.

TABLE 3

| Sample Number | Composition | Silicon Dioxide Matting Agent: Average Particle Size (μm) | Pore Diameter (Å) | Surface Area ($m^2/g$) | Amount Coated ($mg/m^2$) | (1) Extent of Pinhole Formation* | (2) Vacuum Contact Properties (sec.) |
|---|---|---|---|---|---|---|---|
| 12 (Invention) | Silicon dioxide | 3.5 | 25 | 700 | 50 | 20 | 43 |
| 13 (Comp. Ex.) | Silicon dioxide | 3.5 | 210 | 300 | 50 | 100 | 45 |
| 14 (Comp. Ex.) | Poly(methyl methacrylate | 2.5 | — | — | 50 | 20 | 90 |

*Relative values taking rate of occurrence for Sample 13 to be 100.

It is clear from Table 3 that Sample 12 of the present invention had good vacuum contact properties and exhibited remarkably few pinholes.

EXAMPLE 4

Both surfaces of a biaxially expanded poly(ethylene terephthalate) film of thickness 100 μm were subjected to a corona discharge treatment under the conditions indicated below, after which an aqueous dispersion of a 65/30/5 wt.% methyl methacrylate/ethyl acrylate/acrylic acid copolymer and 2,4-dichloro-6-hydroxy-s-triazine were coated uniformly at rates of 0.3 $g/m^2$ (as solid fraction) and 12 $mg/m^2$ respectively and dried. Following a corona discharge treatment, an aqueous dispersion of a 90/8/2 wt-% vinylidene chloride/methyl methacrylate/acrylonitrile copolymer and 2,4-dichloro-6-hydroxy-s-triazine were coated uniformly at rates of 1 $g/m^2$ (as solid fraction) and 2 $mg/m^2$ over the top on both sides as a waterproofing layer, and dried. Moreover, after a coronal discharge treatment, a layer comprising 0.1 $g/m^2$ of gelatin, 1 $mg/m^2$ of compound 16, and 5 $mg/m^2$ of methyl cellulose (60SH-S made by Shinetsu Chemical Industry Co., Ltd.) was coated uniformly over both surfaces and dried.

Corona Discharge Treatment Conditions

A 6 kVA model solid state corona discharge treatment machine made by the Piraa Co. was used and a support of width 30 cm was treated at the rate of 20 m/min. At this time, the material was being treated at the rate of 0.37 kVA·min/$m^2$ according to the values read off for the current and the voltage. The discharge frequency during the treatment was 9.6 KHz, and the gap clearance between the electrode and the dielectric roll was 1.6 mm.

Compound 16

$C_{12}H_{25}O(CH_2CH_2O)_{10}H$

The silver halide emulsion layers 1 and 2 and the protective layers 2 and 3 of the formulations (5), (6), (7) and (8) in Example 1 were coated sequentially on one side of the support which had been obtained in this way. Matting agent was added to the protective layer 3 as shown in Table 4. Moreover, the backing layer and the protective layer 1 of formulations (19) and (20) indicated below were coated on the reverse side of the support.

| Formulation (19) Backing Layer | |
|---|---|
| Gelatin | 226 $mg/m^2$ |
| Sodium dodecylbenzenesulfonate | 9 $mg/m^2$ |
| Sodium dihexyl-α-sulfosuccinate | 33 $mg/m^2$ |
| Poly(sodium styrenesulfonate) | 5 $mg/m^2$ |
| $SnO_2/Sb$ (9/1 by weight, average particle size 0.25 μm) | 280 $mg/m^2$ |

| Formulation (20) Protective Layer 1 | |
|---|---|
| Gelatin | 2.1 $g/m^2$ |
| Compound 7 | 100 $mg/m^2$ |
| Compound 1 | 260 $mg/m^2$ |
| Compound 2 | 35 $mg/m^2$ |
| Compound 3 | 45 $mg/m^2$ |
| Sodium dodecylbenzenesulfonate | 45 $mg/m^2$ |
| Sodium dihexyl-α-sulfosuccinate | 25 $mg/m^2$ |
| Silicon dioxide matting agent (average particle size 3.5 μm, pore diameter 170 Å, surface area 300 $m^2$/gram | 30 $mg/m^2$ |

The samples obtained in this way were evaluated in respect of the extent of pinhole formation and vacuum contact properties in the same way as described in Example 1. The results obtained are shown in Table 4.

Compound 17

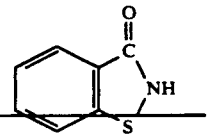

TABLE 4

| Sample Number | Silicon Dioxide Matting Agent: Composition | Average Particle Size (μm) | Pore Diameter (Å) | Surface Area ($m^2/g$) | Amount Coated ($mg/m^2$) | (1) Extent of Pinhole Formation* | (2) Vacuum Contact Properties (sec.) |
|---|---|---|---|---|---|---|---|
| 15 (Invention) | Silicon dioxide | 3.5 | 25 | 700 | 50 | 10 | 40 |
| 16 (Comp. Ex.) | Silicon dioxide | 3.5 | 170 | 300 | 50 | 60 | 45 |
| 17 (Comp. Ex.) | Poly(methyl methacrylate | 2.5 | — | — | 50 | 100 | 60 |

*Relative values taking rate of occurrence for Sample 17 to be 100.

It is clear from Table 4 that Sample 15 of the present invention had good vacuum contact properties and exhibited remarkably few pinholes.

EXAMPLE 5

The first undercoating layer of formulation (21) and the second undercoating layer of formulation (22) indicated below were coated sequentially onto both sides of a biaxially extended poly(ethylene terephthalate) support of thickness 100 μm.

| Formulation (21) First Undercoating layer | |
|---|---|
| An aqueous dispersion of a vinylidene chloride/methyl methacrylate/acrylonitrile/methacrylic acid (90/8/1/1 by weight) copolymer | 15 parts by weight |
| 2,4-Dichloro-6-hydroxy-s-triazine | 0.25 part by weight |
| Fine polystyrene particles (average particle size 3 μm) | 0.05 part by weight |
| Compound 16 | 0.20 part by weight |
| Water to make up to | 100 parts by weight |

The coating liquid which had been adjusted to pH 6 by adding 10 wt % KOH was coated in such a way as to provide a dry film thickness of 0.9 μm after drying for 2 minutes at a drying temperature of 180° C.

Compound 16

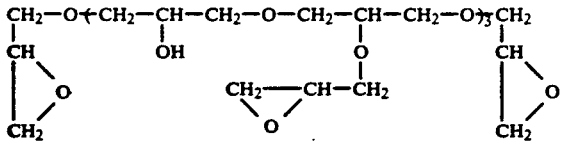

| Formulation (22) Second Undercoating layer | |
|---|---|
| Gelatin | 1 part by weight |
| Methylcellulose | 0.05 part by weight |
| Compound 18 | 0.02 part by weight |
| $C_{12}H_{25}O(CH_2CH_2O)_{10}H$ | 0.03 part by weight |
| Compound 17 | $3.5 \times 10^{-3}$ part by weight |
| Acetic acid | 0.2 part by weight |
| Water to make up to | 100 parts by weight |

This coating liquid was coated in such a way as to provide a dry film thickness of 0.1 μm on drying for 2 minutes at a drying temperature of 170° C.

Compound 18

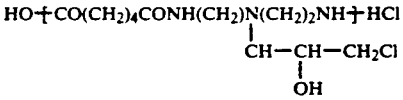

The electrically conductive layer and the backing layer of formulations (23) and (24) were coated on one side of the support obtained in this way. The samples which had no electrically conductive layer shown in Table 5 were coated with the omission of the $SnO_2/Sb$ from formulation 23.

| Formulation (23) Electrically Conductive Layer | |
|---|---|
| $SnO_2/Sb$ (9/1 by weight, average particle size 0.25 μm) | 300 $mg/m^2$ |
| Gelatin | 170 $mg/m^2$ |
| Compound 17 | 7 $mg/m^2$ |
| Sodium dodecylbenzenesulfonate | 10 $mg/m^2$ |
| Sodium dihexyl-α-sulfosuccinate | 40 $mg/m^2$ |
| Poly(sodium styrenesulfonate) | 9 $mg/m^2$ |
| **Formulation (24) Backing Layer** | |
| Gelatin | 2.9 $g/m^2$ |
| Compound 1 | 300 $mg/m^2$ |
| Compound 2 | 50 $mg/m^2$ |
| Compound 3 | 50 $mg/m^2$ |
| Compound 7 | 10 $mg/m^2$ |
| Sodium dodecylbenzenesulfonate | 70 $mg/m^2$ |
| Sodium dibenzyl-α-sulfosuccinate | 15 $mg/m^2$ |
| 1,2-Bis(vinylsulfonylacetamido)ethane | 150 $mg/m^2$ |
| Ethyl acrylate latex (average particle size 0.05 μm) | 500 $mg/m^2$ |
| Lithium perfluorooctanesulfonate | 10 $mg/m^2$ |
| Fine silicon dioxide powder particles (average particle size 4 μm, pore diameter 170 Å, surface area 300 $m^2/g$) | 35 $mg/m^2$ |

The emulsion layers 1 and 2 and the protective layers 1 and 2 of formulations (25), (26), (27) and (28) were coated sequentially onto the opposite side of the support. Matting agents and lubricants were added to the protective layer 2 as indicated in Table 5.

Formulation (25) Silver Halide Emulsion Laver 1

Liquid I: 300 ml of water, 9 grams of gelatin
Liquid II: 100 grams of $AgNO_3$, 400 ml of water
Liquid III: 37 grams of NaCl, 1.1 mg of $(NH_4)_3RhCl_6$ and 400 ml of water Liquid II and Liquid III were added simultaneously at a constant rate to Liquid I which was being maintained at 45° C. The soluble salts were subsequently removed from the emulsion in the usual way well known in the industry, after which gelatin was added, and 6-methyl-4-hydroxy-1,3,3a, 7-tetraazaindene was added as a stabilizer. The average grain size of this mono-disperse emulsion was 0.20 μm and the gelatin content was 60 grams per kg of recovered emulsion.

The compounds indicated were added to the emulsion so obtained.

| | |
|---|---|
| Illustrative compound (I-30) of general formula (I) | $6 \times 10^{-3}$ mol/mol · Ag |
| Compound 4 | 60 mg/m$^2$ |
| Compound 5 | 9 mg/m$^2$ |
| Compound 7 | 10 mg/m$^2$ |
| Poly(sodium styrenesulfonate) | 40 mg/m$^2$ |
| N-Oleoyl-N-methyltaurine, sodium salt | 50 mg/m$^2$ |
| 1,1'-Bis(vinylsulfonyl)methane | 45 mg/m$^2$ |
| 1-Phenyl-5-mercaptotetrazole | 3 mg/m$^2$ |
| Ethyl acrylate latex (average particle size 0.05 μm) | 0.46 g/m$^2$ |

The coating liquid obtained in this way was coated in such a way as to provide a coated silver weight of 1.4 g/m$^2$.

Formulation (26) Silver Halide Emulsion Laver 2

Liquid I: 300 ml of water, 9 grams of gelatin
Liquid II: 100 grams of $AgNO_3$, 400 ml of water
Liquid III: 37 grams of NaCl, 2.2 mg of $(NH_4)_3RhCl_6$ and 400 ml of water Liquid II and Liquid III were added simultaneously to Liquid I in the same way as in the case of the emulsion of formulation (25). The average grain size of this mono-disperse emulsion was 0.20 μm.

The compounds indicated were added to the emulsion so obtained.

| | |
|---|---|
| Emulsified dispersion of a hydrazine compound, Illustrative Compound (I-30) of general formula (I) | $5 \times 10^{-3}$ mol/mol · Ag |
| Compound 4 | 60 mg/m$^2$ |
| Compound 5 | 9 mg/m$^2$ |
| Compound 7 | 10 mg/m$^2$ |
| Poly(sodium styrenesulfonate) | 50 mg/m$^2$ |
| N-Oleoyl-N-methyltaurine, sodium salt | 40 mg/m$^2$ |
| 1,1'-Bis(vinylsulfonyl)methane | 50 mg/m$^2$ |
| 1-Phenyl-5-mercaptotetrazole | 3 mg/m$^2$ |
| Ethyl acrylate latex (average particle size 0.05 μm) | 0.40 g/m$^2$ |

The coating liquid obtained in this way was coated in such a way as to provide a coated silver weight of 1.3 g/m$^2$.

| Formulation (27) Protective Layer 1 | |
|---|---|
| Gelatin | 1.0 g/m$^2$ |
| α-Lipoic acid | 10 mg/m$^2$ |
| Sodium dodecylbenzenesulfonate | 5 mg/m$^2$ |
| Compound 4 | 40 mg/m$^2$ |
| Compound 8 | 20 mg/m$^2$ |
| Poly(sodium styrenesulfonate) | 10 mg/m$^2$ |
| 1-Phenyl-5-mercaptotetrazole | 5 mg/m$^2$ |
| Compound 9 | 20 mg/m$^2$ |
| Ethyl acrylate latex (average particle size 0.05 μm | 200 mg/m$^2$ |
| **Formulation (29) Protective Layer 2** | |
| Gelatin | 1.0 g/m$^2$ |
| Matting agent | (Table 5) |
| Lubricant | (Table 5) |
| Sodium dodecylbenzenesulfonate | 20 mg/m$^2$ |
| Sodium perfluorooctanesulfonate | 10 mg/m$^2$ |
| N-Perfluorooctanesulfonyl-N-propyl-glycine, potassium salt | 3 mg/m$^2$ |
| Poly(sodium styrenesulfonate) | 2 mg/m$^2$ |
| Sodium salt of the sulfate ester of poly (degree of polymerization 5) oxyethylene nonylphenyl ether | 20 mg/m$^2$ |
| Colloidal silica (particle size 15 mμ) | 20 mg/m$^2$ |

Samples 18–27 obtained in this way were evaluated in respect of surface resistivity and pinhole formation using the methods outlined below, and in respect of vacuum contact properties using the method described in Example 1.

The results obtained are shown in Table 5. It is clear from Table 5 that Samples 21–24 of the present invention had good vacuum contact properties and gave rise to the formation of very few pinholes.

(1) Surface Resistivity

The samples were left to stand for 12 hours at 25° C., 25% relative humidity (RH), after which brass electrodes (the part in contact with the sample was made of stainless steel) of length 10 cm were located with a spacing of 0.14 cm and the surface resistivity value after one minute was measured using a TR8651 electrometer made by Takeda Riken.

(2) Pinhole Formation

The samples were left to stand for 3 hours in a normal room with no special air purification system at 25° C., 25% RH, after which they were rubbed with a neoprene rubber roller and then, after sitting for about 30 minutes, they were exposed and developed at 38° C. for 20 seconds using an FG-660F automatic developing processor (made by Fuji Photo Film Co., Ltd.), and the extent of pinhole formation due to attached dust, pull marks and scratches etc. was obtained.

TABLE 5

| | | Protective Layer 2 | | | | | | | |
|---|---|---|---|---|---|---|---|---|---|
| | | Matting Agent | | | | | | | |
| Sample No. | Conductive Layer* ($SnO_2$/Sb Present) | Compound | Pore Size (Å) | Surface Area (m$^2$/g) | Average Diameter (μm) | Coated Wt. (mg/m$^2$) | Lubricant (Amount Coated) (mg/m$^2$) | Extent of Pinhole Formation ** | Vacuum Contact Properties (sec) |
| 18 (Comparison) | No | Poly(methyl methacrylate | — | — | 2.5 | 50 | — | 60 | 90 |
| 19 (Comparison) | No | As above | — | — | 2.5 | 50 | Liquid Paraffin (40) | 55 | 90 |
| 20 (Comparison) | Yes | As Above | — | — | 2.5 | 50 | As Above | 50 | 90 |
| 21 (Invention) | No | Silicon dioxide | 25 | 700 | 3.5 | 50 | — | 50 | 42 |
| 22 (Invention) | No | As Above | 25 | 700 | 3.5 | 50 | Liquid Paraffin (40) | 30 | 42 |
| 23 (Invention) | Yes | As Above | 25 | 700 | 3.5 | 50 | As Above | 10 | 42 |
| 24 (Invention) | Yes | As Above | 25 | 700 | 3.5 | 50 | Illustrative Cpd S-1 (40) | 10 | 42 |
| 25 (Comparison) | No | As Above | 170 | 300 | 3.5 | 50 | — | 100 | 47 |
| 26 (Comparison) | No | As Above | 170 | 300 | 3.5 | 50 | Liquid Paraffin (40) | 90 | 47 |

TABLE 5-continued

| Sample No. | Conductive Layer* ($SnO_2$/Sb Present) | Protective Layer 2 Matting Agent Compound | Pore Size (Å) | Surface Area ($m^2/g$) | Average Diameter (μm) | Coated Wt. ($mg/m^2$) | Lubricant (Amount Coated) ($mg/m^2$) | Extent of Pinhole Formation ** | Vacuum Contact Properties (sec) |
|---|---|---|---|---|---|---|---|---|---|
| 28 (Comparison) | Yes | As Above | 170 | 300 | 3.5 | 50 | As Above | 70 | 47 |

*The surface resistance value of the electrically conductive layer was $2 \times 10^{10}$ Ω when $SnO_2$/Sb was present and $5 \times 10^{15}$ Ω when the $SnO_2$/Sb was absent.
**Relative values taking the rate of occurrence of pinholes with Sample 25 to be 100.

EXAMPLE 6

4-Hydroxy-6-methyl-1,3,3a,7-tetra -azaindene was added as a stabilizer without chemical ripening to a silver chlorobromide emulsion (1 mol % Br, average grain size 0.2 μm) which contained $1 \times 10^{-5}$ mol/mol-.Ag of rhodium. The tetrazolium salt:

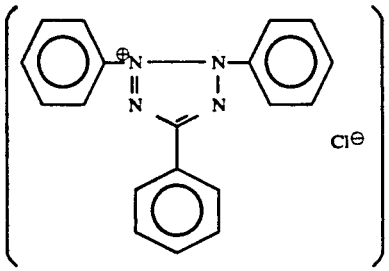

was added to this emulsion at the rate of $5 \times 10^{-3}$ mol/-mol.Ag. Moreover, ethyl acrylate latex (average particle size 0.05 μm) and 1,1'-bis(vinylsulfonyl)methane were added in such a way as to provide coated weights of 0.9 $g/m^2$ and 100 $mg/m^2$ respectively. The emulsion was then coated onto the opposite side of a support to that on which the electrically conductive layer and the backing layer of Sample 23 in Example 5 had been coated, in such a way as to provide a coated silver weight of 3.0 $g/m^2$ and a gelatin coating of 2.3 $g/m^2$. The same protective layers 1 and 2 as used for Sample 23 were then coated sequentially as protective layers over this to provide Sample 28. Next, the sample was evaluated in respect of pinhole formation and vacuum contact properties in the same way as described in Example 5. On this occasion, however, development processing was carried out for 30 seconds at 28° C. using the developer indicated below and the same fixer as used in Example 5.

The results obtained showed that Sample 28 of the present invention had good vacuum contact properties when compared with the comparative samples of Example 5, and that very few pinholes were formed.

| Developer | |
|---|---|
| Ethylenediamine tetra-acetic acid, di-sodium salt (di-hydrate) | 0.75 gram |
| Anhydrous potassium sulfate | 51.7 grams |
| Anhydrous potassium carbonate | 60.4 grams |
| Hydroquinone | 15.1 grams |
| 1-Phenyl-3-pyrazolidone | 0.51 grams |
| Sodium bromide | 2.2 grams |
| 5-Methylbenztriazole | 0.124 grams |
| 1-Phenyl-5-mercaptotetrazole | 0.018 grams |
| 5-Nitroindazole | 0.106 grams |
| Diethyleneglycol | 98 grams |
| Water to make up to | 1 liter |

-continued

| Developer |
|---|
| (pH = 10.5) |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer and at least one light-insensitive upper layer, wherein the light-insensitive upper layer contains porous fine powder particles having a surface area of at least 400 $m^2/g$ and an average pore diameter of less than 170 Å.

2. A silver halide photographic material as in claim 1, wherein the porous fine powder particles have an average particle size of from 0.1 μm to 20 μm.

3. A silver halide photographic material as in claim 1, wherein the porous fine powder particles have an average particle size of from 1 μm to 10 μm.

4. A silver halide photographic material as in claim 1, wherein the surface area of the porous fine powder particles is from 600 to 1,000 $m^2/g$.

5. A silver halide photographic material as in claim 1, wherein the pores of the porous fine powder particles have an average diameter of less than 150 Å.

6. A silver halide photographic material as in claim 1, wherein the porous fine powder is an inorganic substance selected from the group consisting of silicon dioxide, titanium and aluminum oxides, zinc and calcium carbonates, barium and calcium sulfates and calcium and aluminum silicates; or a natural or synthetic organic polymer selected from the group consisting of a cellulose ester, poly(methyl methacrylate), polystyrene, polydivinylbenzene and copolymers thereof.

7. A silver halide photographic material as in claim 1, wherein the porous fine powder particles are contained in the uppermost light-insensitive layer.

8. A silver halide photographic material as in claim 1, wherein the porous fine powder particles are added in an amount of from 5 to 400 $mg/m^2$ of photographic material.

9. A silver halide photographic material as in claim 1, wherein the porous fine powder is added in an amount of from 10 to 200 $mg/m^2$ of photographic material.

10. A silver halide photographic material as in claim 1, wherein a lubricant is included in the uppermost light-insensitive layer of the photographic material.

11. A silver halide photographic material as in claim 10, wherein the lubricant is selected from the group consisting of alkyl polysiloxane and liquid paraffins which are in the liquid state at room temperature.

12. A silver halide photographic material as in claim 10, wherein the lubricant is added in an amount of from 0.1 to 50 wt % with respect to the amount of binder contained in the uppermost light-insensitive layer.

13. A silver halide photographic material as in claim 10, wherein the lubricant is added in an amount of from 0.5 to 30 wt % with respect to the amount of binder contained in the uppermost light-insensitive layer.

14. A silver halide photographic material as in claim 1, wherein at least one of the structural layers of the photographic material is an electrically conductive layer having a surface resistivity of not more than $10^{12}$ Ω measured at 25% relative humidity and 25° C.

15. A silver halide photographic material as in claim 14, wherein the electrically conductive layer comprises an electrically conductive metal oxide or an electrically conductive polymer compound.

16. A silver halide photographic material as in claim 15, wherein the electrically conductive metal oxide or electrically conductive polymer compound is added in an amount of from 0.05 to 20 grams per square meter of photographic material.

17. A silver halide photographic material as in claim 15, wherein the electrically conductive metal oxide or electrically conductive polymer compound is added in an amount of from 0.1 to 10 grams per square meter of photographic material.

18. A silver halide photographic material as in claim 14, wherein the surface resistivity measured at 25% relative humidity and 25° C. is not more than $10^{11}$ Ω.

19. A silver halide photographic material as in claim 14, wherein a fluorine-containing surfactant is added to at least one layer in the photographic material.

20. A silver halide photographic material as in claim 1, wherein the photographic material contains (a) tetrazolium compound or (b) a hydrazine compound represented by the general formula (I) below:

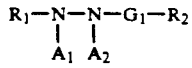

(I)

wherein $R_1$ represents an aliphatic group or an aromatic group; $R_2$ represents a hydrogen atom, an alkyl group, an aryl group, an alkoxy group, an aryloxy group, an amino group, a hydrazino group, a carbamoyl group or an oxycarbonyl group; $G_1$ represents a carbonyl group, a sulfonyl group, a sulfoxy group,

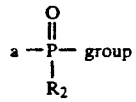

wherein $R_2$ is the same as define above,

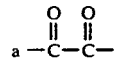

group, a thiocarbonyl group or an iminomethylene group; and $A_1$ and $A_2$ both represent hydrogen atoms, or one of them represents a hydrogen atom and the other represents a substituted or unsubstituted alkylsulfonyl group, a substituted or unsubstituted arylsulfonyl group, or a substituted or unsubstituted acyl group.

* * * * *